US007309273B2

(12) United States Patent
Ogihara

(10) Patent No.: US 7,309,273 B2
(45) Date of Patent: Dec. 18, 2007

(54) ADJUSTABLE STEERING MECHANISM FOR RADIO FREQUENCY TOY CONTROLLER

(75) Inventor: Nobuaki Ogihara, Kawaguchi (JP)

(73) Assignee: Radioshack Corporation, Fort Worth, TX (US)

( * ) Notice: Subject to any disclaimer, the term of this patent is extended or adjusted under 35 U.S.C. 154(b) by 62 days.

(21) Appl. No.: 11/343,038

(22) Filed: Jan. 30, 2006

(65) Prior Publication Data

US 2006/0121876 A1 Jun. 8, 2006

Related U.S. Application Data

(62) Division of application No. 10/681,085, filed on Oct. 8, 2003, now Pat. No. 7,029,363.

(51) Int. Cl.
*A63H 30/00* (2006.01)

(52) U.S. Cl. ..... 446/454; 446/456

(58) Field of Classification Search ..... 446/460, 446/456; 341/176

See application file for complete search history.

(56) References Cited

U.S. PATENT DOCUMENTS 5,158,495 A 10/1992 Yonezawa
6,893,320 B2 5/2005 Caiozza
7,029,363 B2 * 4/2006 Ogihara ..... 446/454
7,128,634 B2 * 10/2006 Ogihara ..... 446/456
2002/0196174 A1 12/2002 Lai
2003/0214428 A1 11/2003 Tokita
2004/0137936 A1 * 7/2004 Mukaida ..... 455/550.1
2005/0168373 A1 8/2005 Mukaida
2006/0141948 A1 * 6/2006 Ogihara ..... 455/95

OTHER PUBLICATIONS

Futaba Digital Proportional R/C System, "3PK 3-Channel Radio Control System Instruction Manual", 2002, pp. 51-52, printed from www.hitecrcd.com/Radios/Discontinued%20Radios/lynx3D.htm.

Hitec Racing, "Lynx 3D Instruction Manual", 2002 p. 4, printed from www.futaba-rc.com/manuals/3pk-manual:pdf.

* cited by examiner

*Primary Examiner*—Robert E. Pezzuto
*Assistant Examiner*—Alex F. R. P. Rada, II
(74) *Attorney, Agent, or Firm*—Haynes and Boone LLP

(57) ABSTRACT

A controller for a radio-controlled toy, comprising a housing, a first interface disposed on a first side of the housing, a second interface disposed on a second side of the housing, and a steering wheel having a steering shaft, the steering shaft being adapted to be inserted into either of the first and second interfaces.

3 Claims, 15 Drawing Sheets

| | RPM | GEAR RATIO | POWER SPEED |
|---|---|---|---|
| M1 | WHITE 26K | 6 | |
| M2 | RED 26K | 5.11 | |
| M3 | YELLOW 26K | 4.40 | |
| M4 | BLUE 26K | 3.82 | |
| M5 | WHITE 30K | 6 | |
| M6 | RED 30K | 5.11 | |
| M7 | YELLOW 30K | 4.40 | |
| M8 | BLUE 30K | 3.82 | |

500

500a

*FIG. 17*

ADJUSTABLE STEERING MECHANISM FOR RADIO FREQUENCY TOY CONTROLLER

CROSS-REFERENCE TO RELATED APPLICATIONS

This invention is a divisional of U.S. patent application Ser. No. 10/681,085, now U.S. Pat. No. 7,029,363 entitled "Adjustable Steering Mechanism for Radio Frequency Toy Controller," filed Oct. 8, 2003 and is related to U.S. patent application Ser. No. 29/191,449 entitled "Packaging for Radio-Controlled Toy" (Inventor: Douglas M. Galletti) filed Oct. 8, 2003, U.S. patent application Ser. No. 29/191,453, now U.S. Design Pat. No. D503,439, entitled "Radio Frequency Toy Controller" (Inventor: Douglas M. Galletti) filed Oct. 8, 2003.

BACKGROUND

This disclosure relates generally to controllers for radio-controlled mobile toys and, more specifically, to providing a controller that is adjustable for left-handed and right-handed use.

A radio-controlled toy, such as a radio-controlled car, is generally operated by a transmitter, or controller, which transmits radio signals to the radio-controlled car. Such controllers are typically configured for one of either left-handed or right-handed use. Thus, separate controllers are required for left-handed and right-handed users. This may be both inconvenient and expensive, as additional effort is expended by manufacturers to provide the separate controllers, and users may need to purchase additional controllers to ensure that anyone desiring to use their radio-controlled car may do so.

Controllers that do allow for adjustability between left-handed and right-handed use are typically quite complicated insofar as allowing for the adjustment.

Therefore, what is needed is a controller that is adjustable for left-handed or right-handed use, yet is relatively simple in accommodating such adjustment.

SUMMARY

A controller for a radio-controlled toy is provided. The controller includes a housing, a first interface disposed on a first side of the housing, a second interface disposed on a second side of the housing, and a steering wheel having a steering shaft, the steering shaft being adapted to be inserted into either of the first and second interfaces.

A controller for a radio-controlled toy is provided wherein the controller is adaptable for left-handed or right-handed use. The controller includes a housing, a right interface positioned on a right side of the housing, a left interface positioned on a left side of the housing, the left interface being substantially symmetric to and aligned with the right interface, a rotatable element disposed between the right and left interfaces, the -rotatable element being in registry with the right and left interfaces, and a steering wheel having a steering shaft. The steering shaft is adapted to engage the rotatable element through either the right interface or the left interface such that rotation of the steering wheel, and therefore the rotatable element, operatively imparts steering signals to the radio-controlled toy.

An assembly for providing steering signals to a radio-controlled toy is provided. The assembly includes means for engaging a rotatable element and imparting rotation to the rotatable element, the rotatable element being disposed within a housing. The assembly further includes means for electromechanically interacting with a steering control circuit disposed within the housing to generate steering signals, such means for electromechanically interacting being operatively connected to the rotatable element. The assembly also includes means for transmitting the steering signals to the radio-controlled toy to control steering of the radio-controlled toy. The rotatable element is further engageable from either side of the housing.

A circuit adapted for receiving steering signals for a radio-controlled toy is provided. The circuit includes a first plurality of terminals associated with a circuit board, wherein each of the first plurality of terminals is arranged relative to the other terminals in a predetermined position on the circuit board, a second plurality of terminals associated with an actuator, wherein the second plurality of terminals is adapted for engaging the first plurality of terminals in response to movement of the actuator and generating a steering signal, wherein the position of the second plurality of terminals relative to the first plurality of terminals indicates the steering signal, and a reverse steering switch having first and second states, wherein the first state is adapted to reverse the steering signal and wherein the second state is adapted to not reverse the steering signal.

A controller for a radio-controlled toy, wherein the controller is adaptable for left-handed or right-handed use is provided. The controller includes a housing, a right interface positioned on a right side of the housing, a left interface positioned on a left side of the housing, the left interface being substantially symmetric to and aligned with the right interface, a rotatable element disposed between the right and left interfaces, the rotatable element being in registry with the right and left interfaces, and a pair of steering wheels having a common steering shaft, the steering shaft being engaged with the rotatable element and the steering wheels being disposed adjacent to the right and left interfaces, whereby rotation of the steering shaft, and therefore the rotatable element, operatively imparts steering signals to the radio-controlled toy.

A method for assembling a controller for use by a right-handed or left-handed user is provided. The method includes providing a controller having a housing, a first interface associated with the housing, a second interface associated with the housing, and a rotatable element disposed between the first interface and the second interface, inserting a steering shaft associated with a steering wheel through the first interface to engage the steering shaft with the rotatable element, assembling a locking plate onto the second interface, and inserting a connector through the locking plate and into the distal end of the steering shaft to secure the locking plate and the steering wheel to the controller.

BRIEF DESCRIPTION OF THE DRAWINGS

FIG. 17 is a chart depicting alternative motors for implementation into the chassis of FIG. 3.

DETAILED DESCRIPTION

Figure 1:
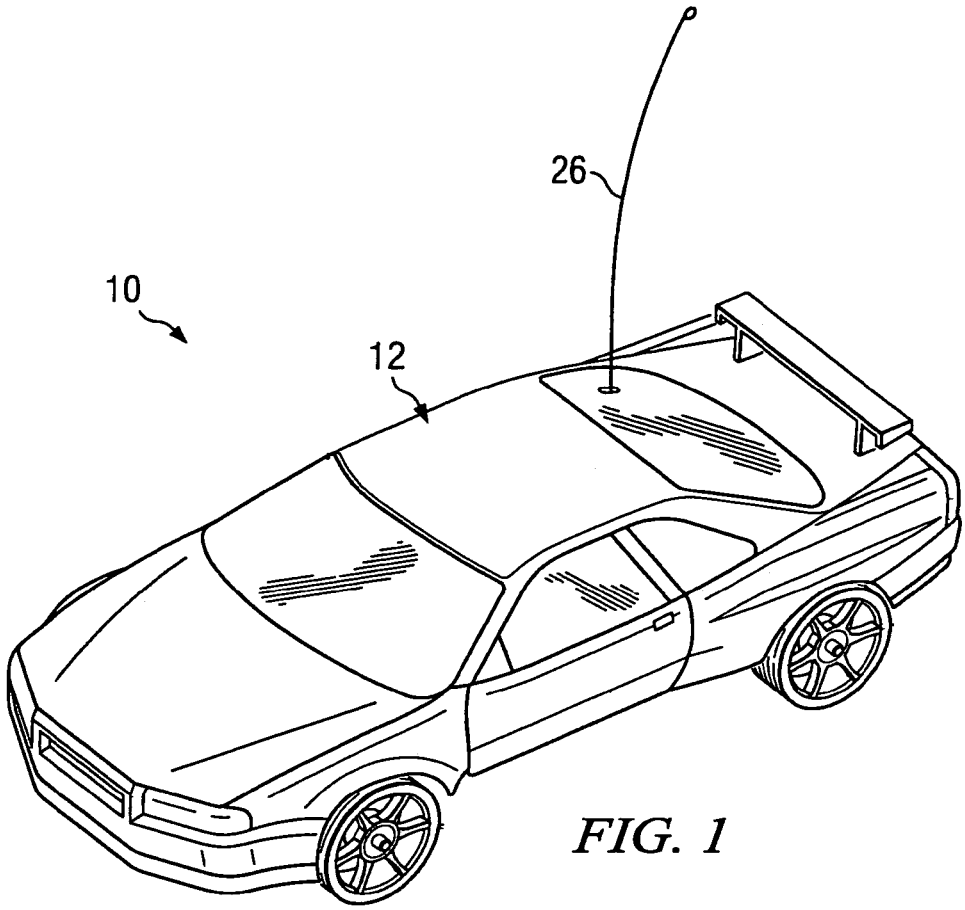
FIG. 1 is a perspective view of a radio-controlled toy car according to one embodiment of the present disclosure.

This disclosure relates generally to controllers for radio-controlled mobile toys and, more specifically, to adjusting such controllers for left-handed or right-handed use. It is understood, however, that the following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
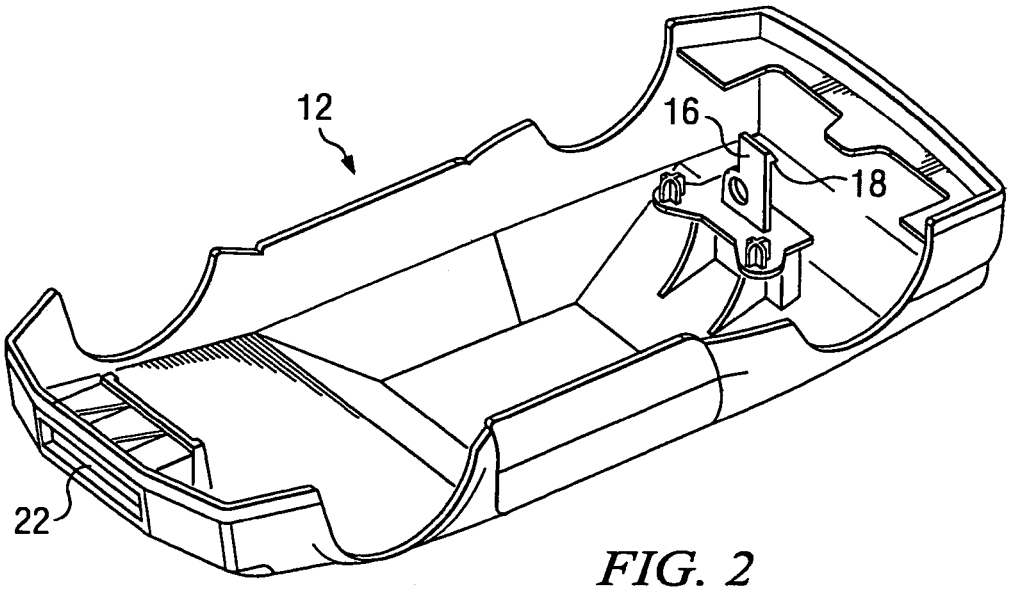
FIG. 2 is a bottom perspective view of a body of the radio-controlled toy car.
Figure 3:
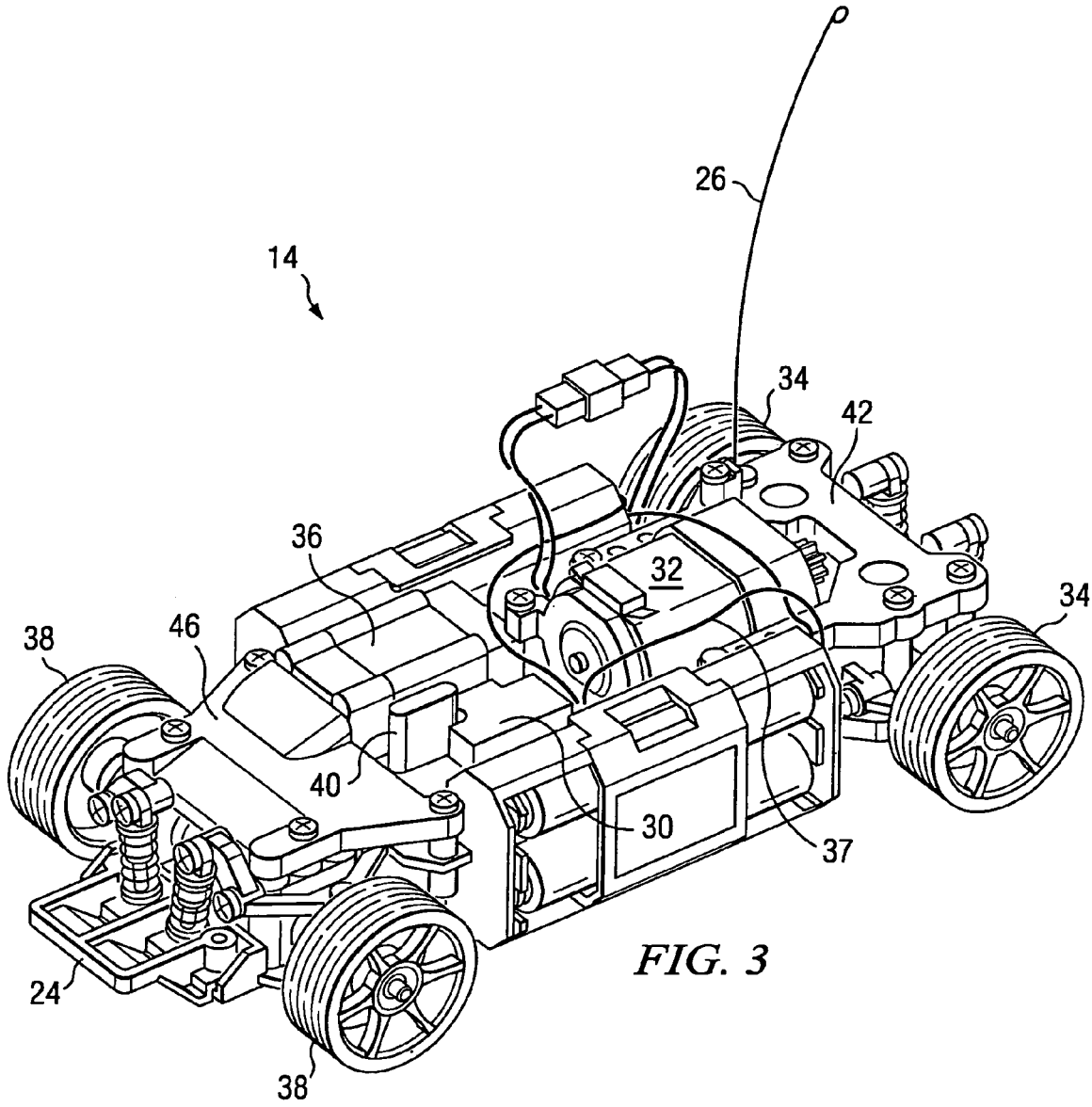
FIG. 3 is a top perspective view of a chassis of the radio-controlled toy car.

Referring to FIGS. 1-3, a radio-controlled car according to one embodiment of the present disclosure is generally referred to by reference numeral 10. The radio-controlled car 10 includes a body 12, which can connect to a chassis 14 (FIG. 3) in a variety of manners including via a conventional pressure fit or snap connection. For example, in one embodiment, referring to FIGS. 2 and 3, the body may include a projection 16 having a lip 18 for engaging a slot 20 (FIG. 8) formed through the chassis 14. Moreover, a front portion of the body 12 (as viewed in FIG. 2) may include a groove 22 for receiving a corresponding extension 24 (FIG. 3) of the chassis, thereby facilitating a snap connection between the body 12 and the chassis 14. Thus, the body 12 is interchangeable with the chassis 14. In one embodiment, a locking mechanism (not depicted) may be used to further removably secure the body 12 with the chassis 14. An antenna 26 for receiving radio signals is also provided on the chassis 14.

Referring now to FIG. 3, the radio-controlled car 10 includes a receiver (generally depicted as being housed in casing 30), which in one embodiment, forms a portion of an electronic speed control member (also generally depicted as being housed in casing 30). Of course, the receiver (housed in 30) and the electronic speed control member (housed in 30) may be positioned at various portions of the chassis 14, and not necessarily at the same portion of the chassis. The receiver (housed in 30) receives a signal from an external radio transmitter, or controller (not shown), and is conventionally adapted to instruct a motor 32 associated with the radio-controlled car 10 to impart rotation to a pair of rear wheels 34 in a forward or rearward direction in a manner to be described. It is understood that for the purposes of this disclosure, substantially similar components are given the same reference numerals. In the present example, the signals received at the receiver (housed in 30) are passed to the motor 32 via the electronic speed control member (housed in 30) and associated wiring, which is generally indicated by reference numeral 37. It is understood that the radio-controlled car 10 is conventionally wired for operation, and as such, wiring associated with other portions of the radio-controlled car will not be described in detail. The electronic speed control member (housed in 30) is also configured to send a signal received through the receiver (housed in 30) to a servomotor (generally depicted as being housed in casing 36), which is adapted to impart left/right motion to a pair of front wheels 38 also in a manner to be described. A frequency crystal 40 is positioned on the chassis 14 in order to allow the external controller (not shown) to communicate with the radio-controlled car 10 on a common frequency.

Figure 4:
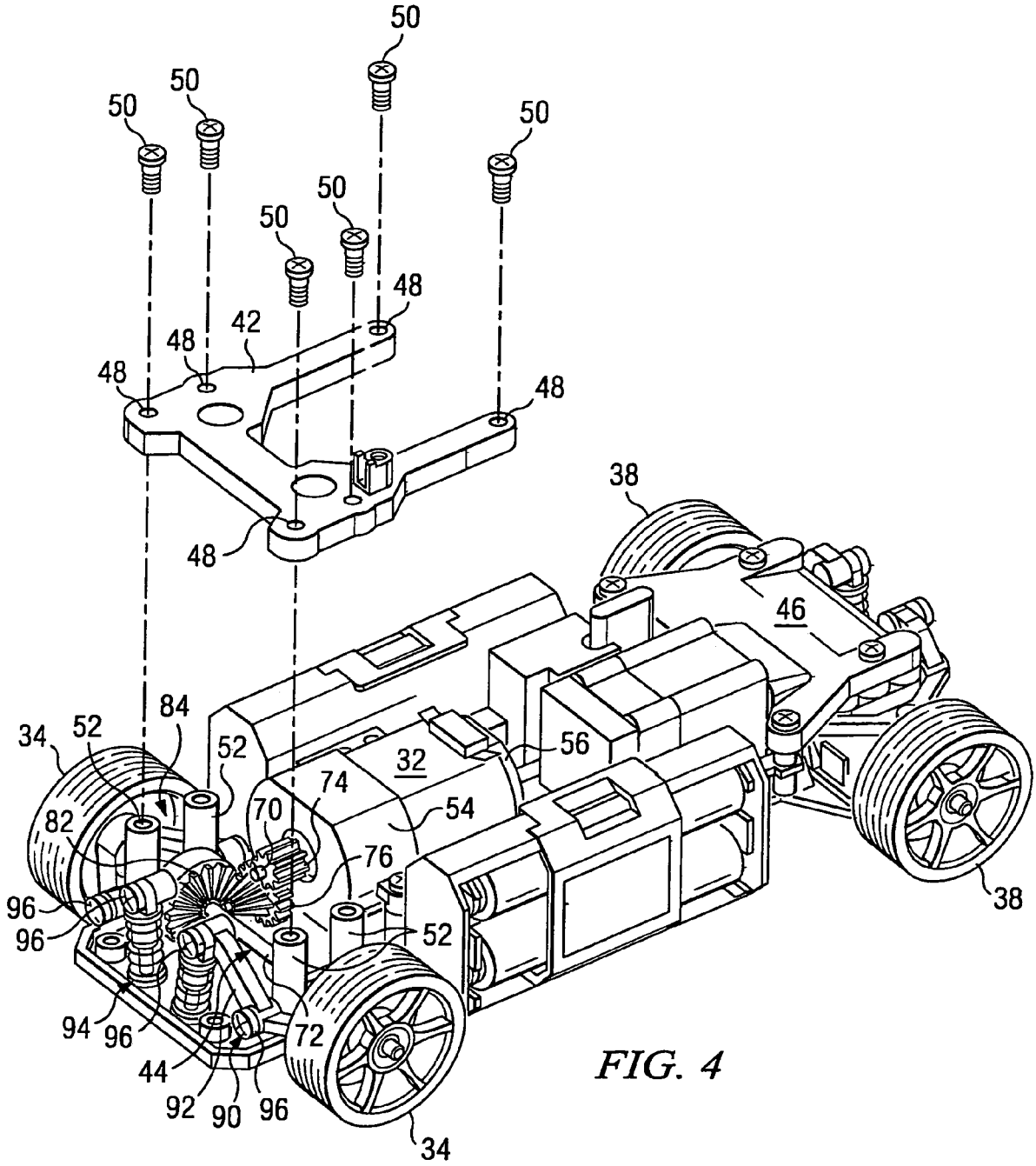
FIG. 4 is a rear perspective view of the chassis with a rear plate exploded from the chassis.
Figures 5, 6:
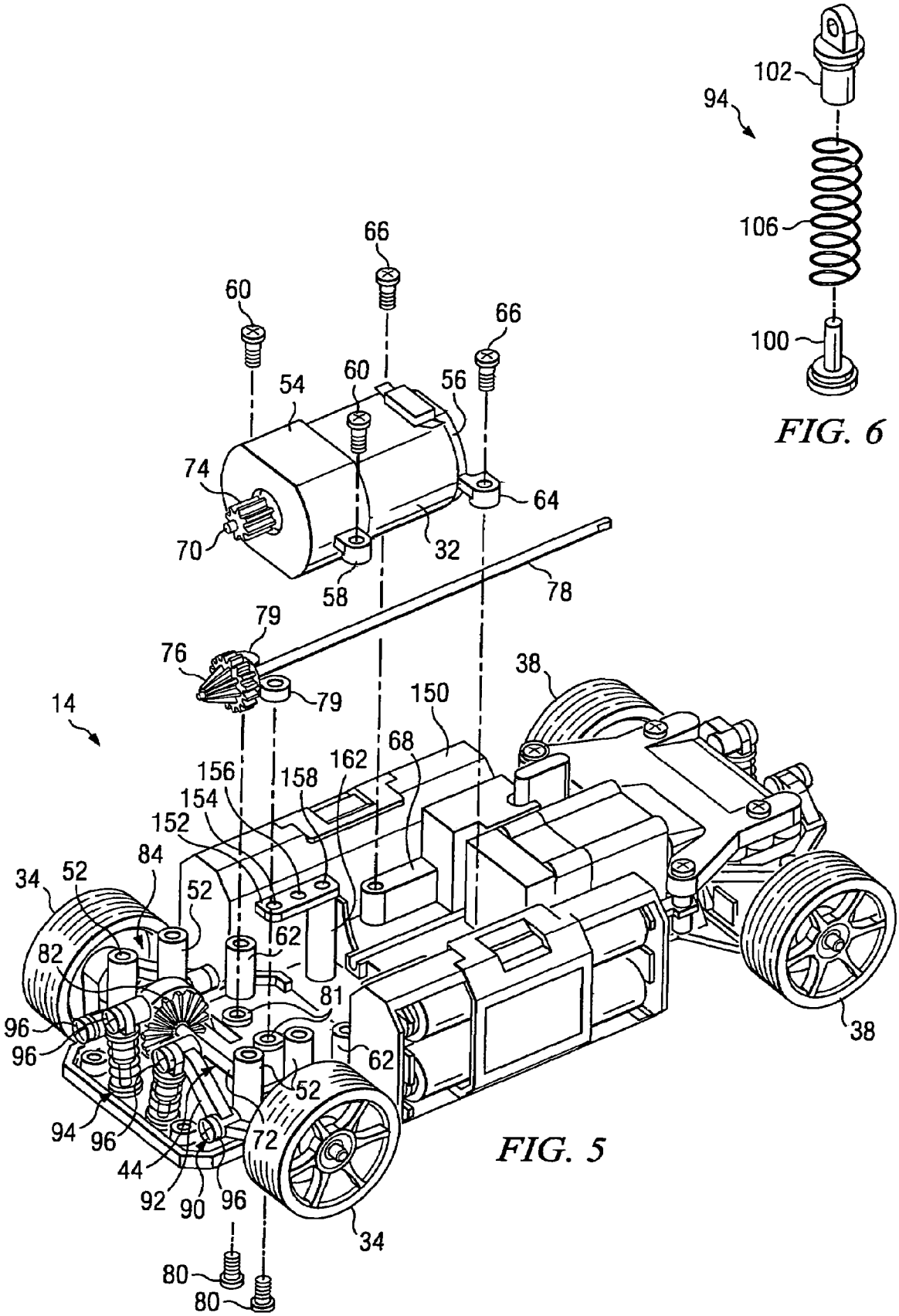
FIG. 5 is a rear perspective view of the chassis with a motor and drive shaft exploded from the chassis and the rear plate removed.
FIG. 6 is a perspective view of a damper assembly of the chassis.

Referring now to FIGS. 4 and 5, in one embodiment, the chassis 14 includes a rear plate 42 for covering a rear axle assembly 44 and a front plate 46 for covering a front portion of the chassis. The rear plate 42 includes a plurality of bores 48 for receiving a plurality of screws 50, which secure to a plurality of corresponding bosses 52 (four of which are shown) integrally formed with and extending from the chassis 14. In the present example, the motor 32 is positioned adjacent to the rear axle assembly 44 such that the motor can drive the rear axle assembly as will be described. In one embodiment, the motor 32 is secured to the chassis 14 via a rear motor casing 54 and a front motor casing 56.

Referring specifically to FIG. 5, the rear motor casing 52 includes a pair of receiving portions 58 (one of which is shown) for receiving a pair of corresponding screws 60, which secure to a pair of bosses 62 integrally formed with and extending from the chassis 14. In a like manner, the front motor casing 56 also includes a pair of receiving portions 64 (one of which is shown) for receiving a pair of corresponding screws 66, which secure to a pair of bosses 68 (one of which is shown) integrally formed with and extending from the chassis 14. Accordingly, the motor 32 is removably secured to the chassis 14. It is understood, however, that the motor 32 can be secured to the chassis 14 in a variety of manners, and therefore, is not limited to the above-described arrangement.

In one embodiment, and referring again to FIGS. 4 and 5, the motor 32 is a conventional motor for a radio-controlled toy, and as such, includes a shaft 70 for imparting motion to a rear axle 72 of the rear axle assembly 44. In the present example, a pinion gear 74 is positioned on the motor shaft 70, and is adapted to engage and impart motion to a bevel gear 76 positioned on a drive shaft 78 (FIG. 5). The drive shaft 78 includes a pair of receiving portions 79 (FIG. 5) for receiving a pair of screws 80 (FIG. 5) via a pair of bores 81 formed through the chassis 14. Accordingly, the drive shaft 78 is removably secured to the chassis 14. The bevel gear 76, in turn, is adapted to engage and impart motion to a rear axle gear 82. In one embodiment, the rear axle gear 82 includes a differential gear assembly to provide for the conventional splitting of torque transferred through the drive shaft 78. Rotation of the rear axle gear 82 imparts motion to the rear axle 72, which is operatively connected to the pair of rear wheels 34 through a pair of rear wheel assemblies 84. As such, the motor 32 is able to drive the rear wheels 34 of the radio-controlled car 10 through the above-described arrangement. It is understood, however, that a variety of gear assemblies are contemplated for operatively connecting the motor shaft 70 with the rear axle 72, and thus, the above-described gear arrangement is not intended to be limiting.

Figure 8:
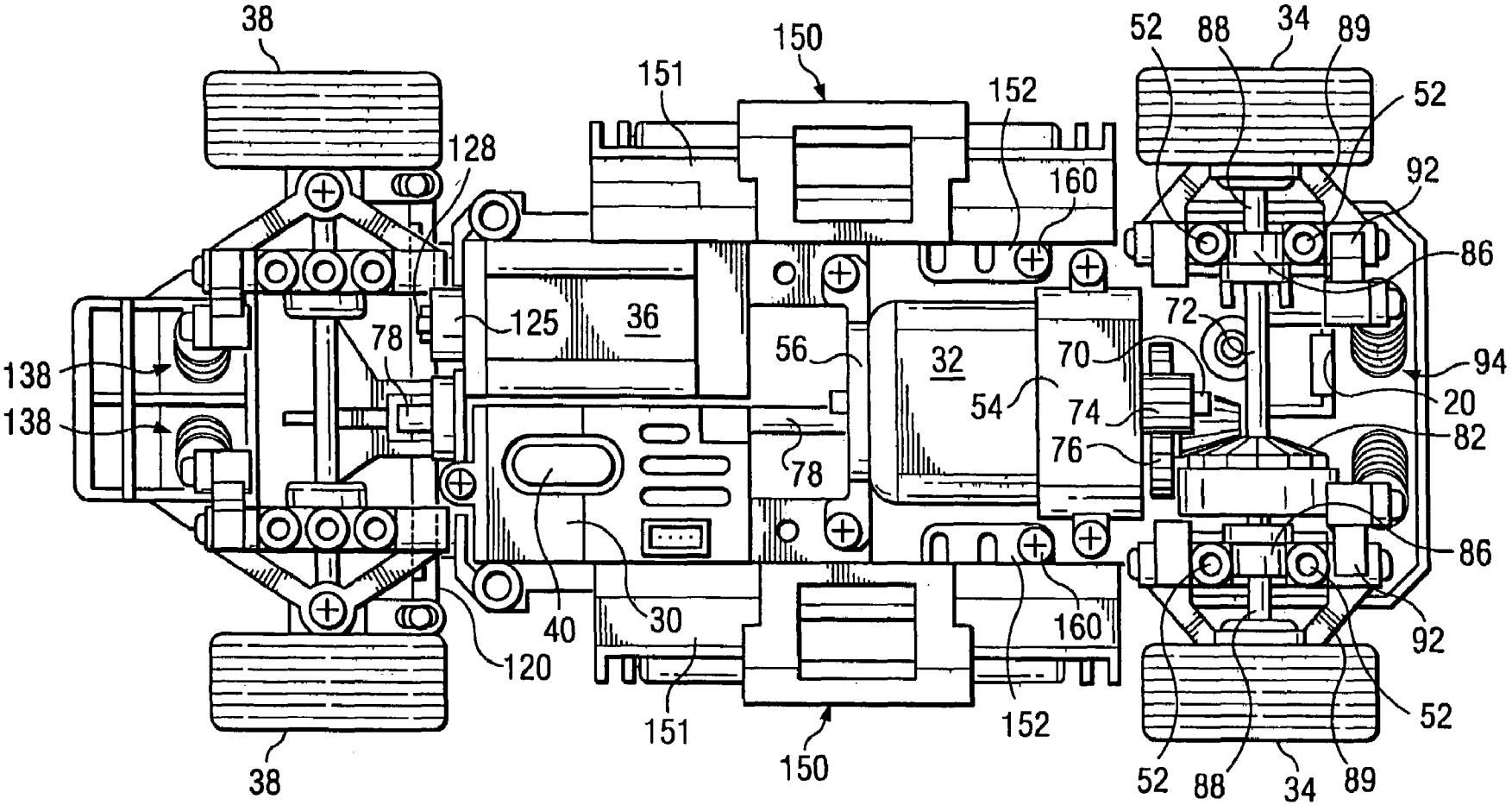
FIG. 8 is top plan view of the chassis with the front and rear plates removed.

As better seen in FIG. 8, in one embodiment, each rear wheel assembly 84 includes a universal joint 86 for connecting the rear axle 72 to a linkage member 88, which transfers the rotational movement of the rear axle 72 to the rear wheels 34. In the present example, the linkage members 88 each pass through a knuckle arm 89 such that movement of the knuckle arms moves the rear wheels 34. In particular, the knuckle arms 89 cooperate with a suspension assembly 90 (FIG. 5) to provide the rear wheels 34 with insulation from shock transferred through the rear wheels, including allowing for an appreciable degree of camber.

In one embodiment, and referring again to FIG. 5, each suspension assembly 90 includes an arm member 92, which links a portion of the knuckle arm 89 to a rear damper assembly 94. In the present example, the rear damper assemblies 94 constitute the portion of the suspension assembly 90 to which shock is transferred and which provides insulation. The arm members 92 are secured to the chassis 14 and the rear damper assemblies 94 in a conventional manner such as via screws 96.

Referring to FIG. 6, in one embodiment, each rear damper assembly 94 includes a pin member 100, which is adapted to engage a sleeve member 102 and which is received in a receptacle (not shown) of the chassis 14. The pin member 100 and the sleeve member 102 cooperate with a coil spring 106; concentrically disposed about each of the pin member and the sleeve member, to cushion shock transmitted through the rear wheels 34.

Figure 7:
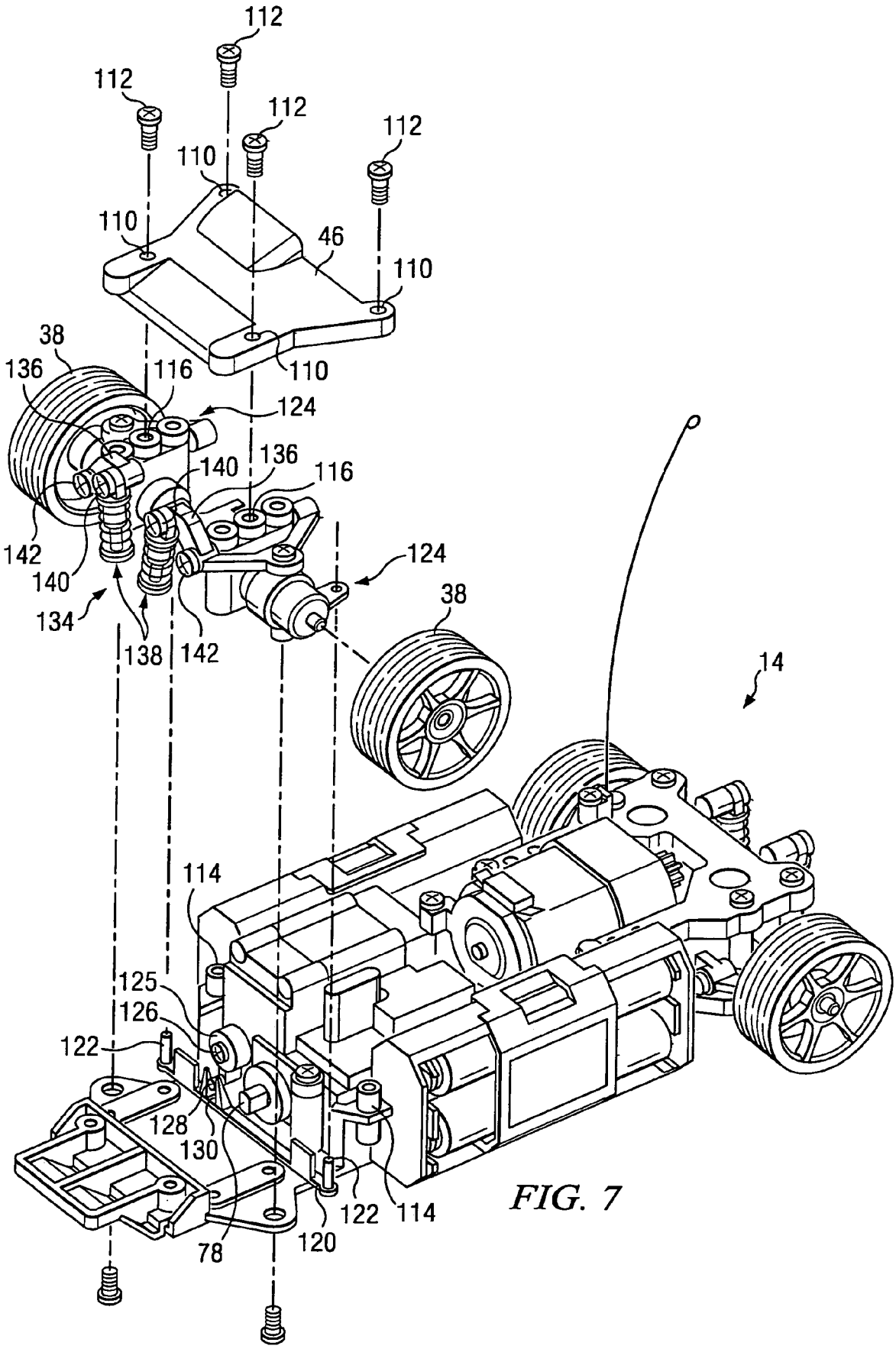
FIG. 7 is a front perspective view of the chassis with a front plate and front-wheel assemblies exploded from the chassis.

Referring now to FIG. 7 in which the front plate 46 is shown exploded from the chassis 14, the front plate 46 includes a plurality of bores 110 for receiving a plurality screws 112, which secure to a plurality of corresponding bosses 114 and 116. In one embodiment, the front wheels 38 are operatively linked to one another via a tie rod 120 that includes distal flange portions 122 for engaging a pair of wheel assemblies 124 associated with the front wheels. The tie rod 120 cooperates with a cam device 125 associated with the servomotor (housed in 36) to provide left/right motion to the front wheels 38, which, in turn, allows for steering control of the radio-controlled car 10. In one embodiment, the cam device 125 is linked to the servomotor (housed in 36) via a rotatable screw 126. In the present example, the cam device 125 includes a protruding portion 128 for engaging a slot 130 defined in the tie rod 120 such that rotation of the cam device, via the screw 126, imparts translational movement to the tie rod, which, in turn, imparts steering movement to the front wheels 38.

In one embodiment, the front wheel assemblies 124 are each connected to a front suspension assembly 134, which is similar in concept to the suspension assemblies 90 associated with the rear wheels 34. In particular, each front suspension assembly 134 includes an arm member 136 for linking the front wheel assembly 124 to a front damper assembly 138, which functions to cushion shock transmitted through the front wheels 38. In one embodiment, the front damper assemblies 138 are substantially similar to the rear damper assemblies 94. Moreover, as described with reference to the rear portion of the radio-controlled car 10 and FIG. 5, the front damper assemblies 138 are connected to the arm members 136 via screws 140, and the arm members 136 are connected to the chassis 14 via screws 142. In one embodiment, the radio-controlled car 10 operates in a two-wheel drive configuration, and thus, the drive shaft 78 extends into the front portion of the chassis 14 and rotates freely.

Figure 9A:
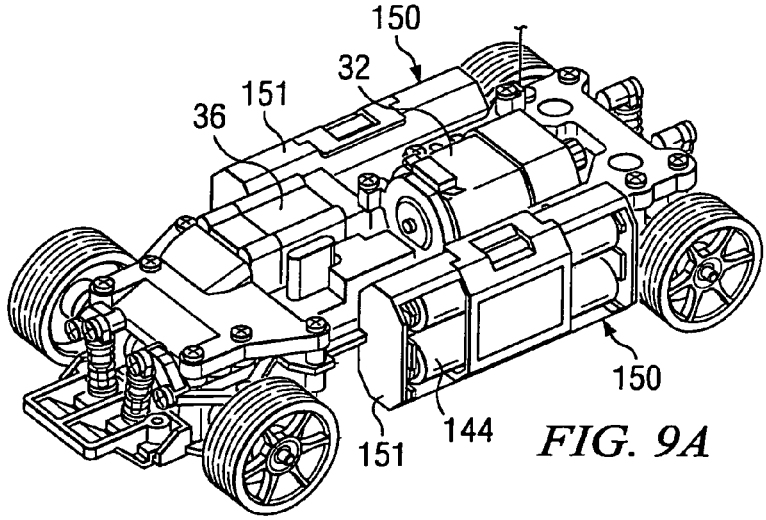
FIG. 9*a* is a perspective view of the radio-controlled car depicting a pair of battery trays of the radio-controlled car in a rear position.
Figure 9B:
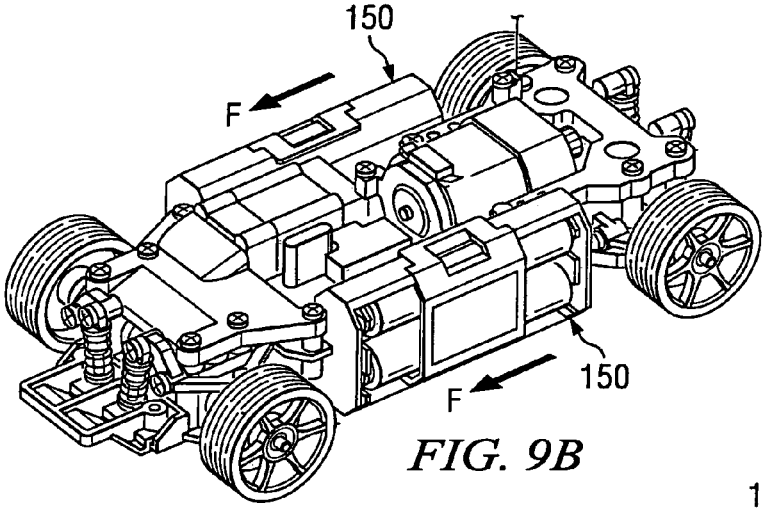
FIG. 9*b* is a perspective view of the radio-controlled car depicting the pair of battery trays of the radio-controlled car in a forward position.

Referring now to FIGS. 9*a*-9*b*, in one embodiment, the motor 32 and servomotor (housed in 36) are powered via batteries 144, which are housed in a pair of battery trays 150. In the present example, the battery trays 150 are positioned on each side of the radio-controlled car 10. The battery trays 150 include a housing 151 for receiving conventional batteries 144, such as AA-standard batteries, and are conventionally wired to transfer power to the motor 32 and the servomotor (housed in 36). In one embodiment, the battery trays 150 are longitudinally adjustable relative to the chassis 14 of the radio-controlled car 10. In the present example, the combined weight of the battery trays 150 and the batteries which are housed therein is significant enough that adjustment of the battery trays can appreciably alter the center of gravity of the radio-controlled car 10.

For example, in a first position depicted in FIG. 9*a*, the battery trays 150 are positioned towards the rear of the chassis 14, which results in the center of gravity of the radio-controlled car 10 being generally along the rear portion of the chassis. In a second position depicted in FIG. 9*b*, the battery trays 150 have been adjusted to a forward position along the chassis 14 (in the direction F), which results in the center of gravity of the radio-controlled car 10 having been shifted forward to an area generally along the middle portion of the chassis. It is understood that the battery trays 150 are adjustable to several positions along the chassis and that the above-described rear and forward positions are for illustration purposes only.

Figure 9C:
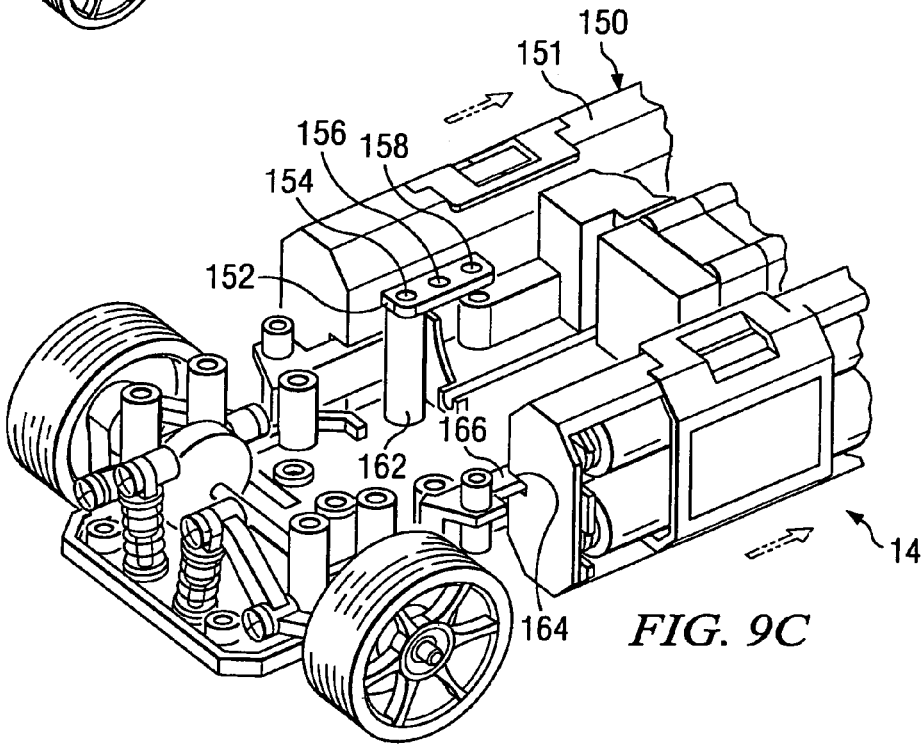
FIG. 9*c* is detailed view of one of the battery trays of FIGS. 9*a* and 9*b* depicting an interaction of the battery tray with the chassis.

To clarify the following description of the battery trays 150 and their interaction with the chassis 14, only one battery tray will be described. Referring now to FIG. 9*c*, in one embodiment, the battery tray 150 includes a flange portion 152 extending laterally towards the chassis 14 as viewed in FIG. 9*c*. A plurality of bores 154, 156 and 158 are defined through the flange portion 152 to receive a screw 160 (FIG. 8), which is adapted to be inserted into a boss 162 integrally formed with and extending from the chassis 14. In this manner, the battery tray 150 can be secured to the chassis 14 upon being adjusted to the desired position along the chassis. In one embodiment, the battery tray 150 further includes a channel 164 for engaging the battery tray with a corresponding flange, or lip 166, of the chassis 14 such that the battery tray is slidable relative to and alongside the chassis.

Thus, if the rear position of the battery tray 150, as viewed in FIG. 9*a*, is desired, the battery tray is adjusted to align the forward-most bore 158 with the boss 162, and the screw 160 is inserted through the bore 158 and into the boss 162, thereby securing the battery tray to the chassis 14. If, however, the forward position of the battery tray 150, as viewed in FIG. 9*b*, is desired, the battery tray is adjusted to align the rear-most bore 154 with the boss 162, and the screw 160 is inserted through the bore 154 and into the boss 162, thereby securing the battery tray to the chassis 14. As can be appreciated, the flange portion 152 may include any number of bores to correspond to any number of positions of the battery tray 150 relative to the chassis. It is understood that other sliding and securing arrangements are contemplated for adjusting the battery tray 150 relative to the chassis 14. For example, in other embodiments, the flange portion 152 and associated screw 160 may be removed and the battery tray 150 may slide and secure to the chassis 14 in a friction fit.

Figure 10A:
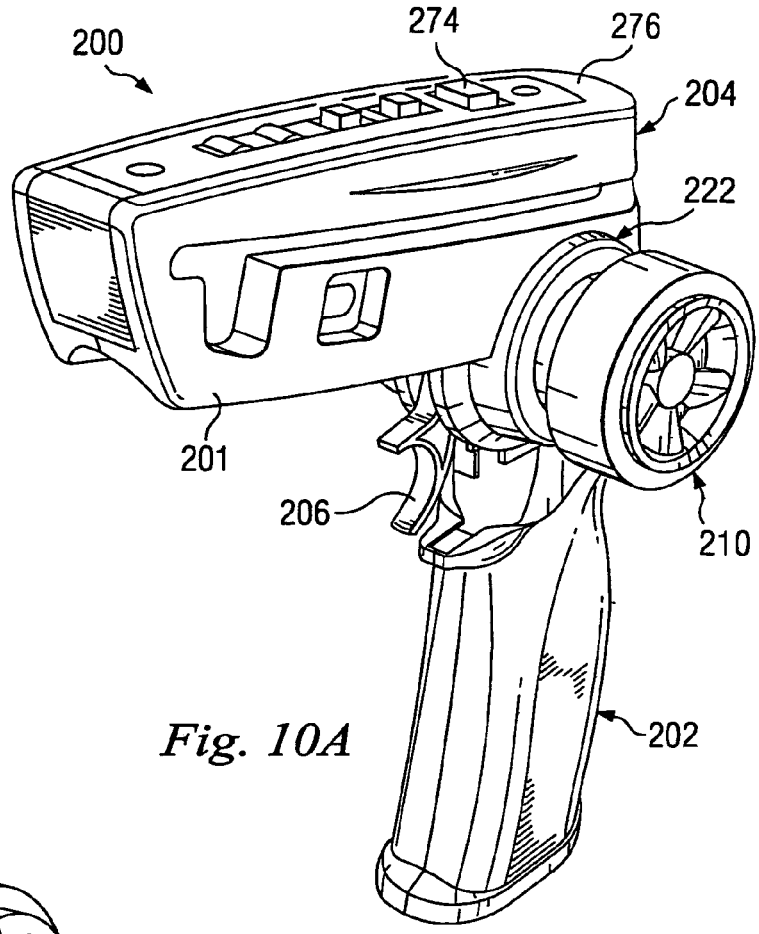
FIG. 10*a* is a perspective view of a controller for use in operating the radio-controlled toy.

Referring now to FIG. 10*a*, the radio-controlled car 10 may be operated by a transmitter, or controller 200, which transmits radio signals to be received by the radio-controlled car 10 (FIG. 1) in a conventional manner. In one embodiment, the controller 200 includes a housing 201, which is gun-like in shape, and as such, includes a handle portion 202 and a body portion 204 situated substantially orthogonal relative to the handle portion. The controller 200 includes a trigger 206, which is adapted to be actuated by a user (not shown) to impart forward/backward motion to the radio-controlled car 10 (FIG. 1).

Figure 10B:
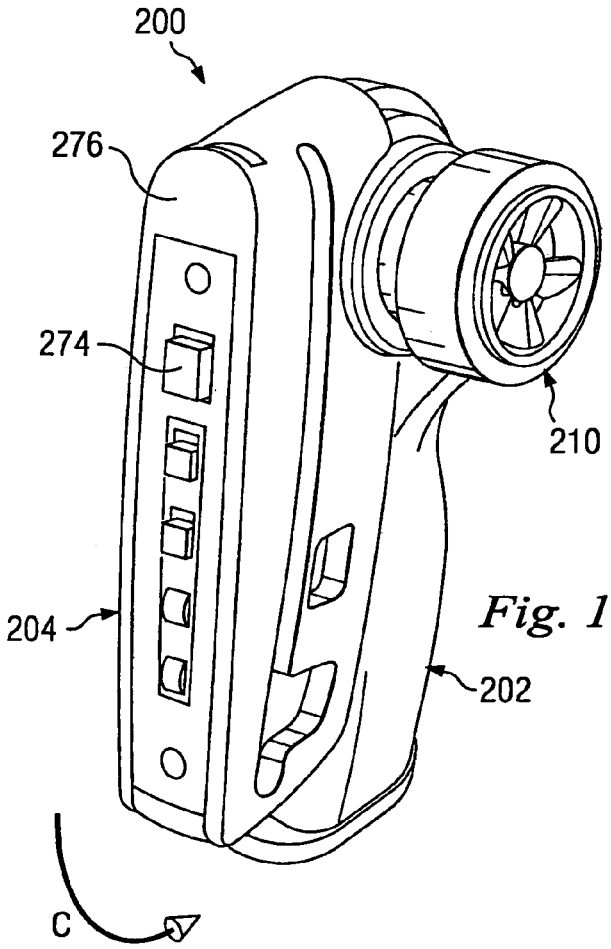
FIG. 10*b* is a perspective view of the controller of FIG. 10*a* in a collapsed position.

In one embodiment, the controller 200 is collapsible from an open position (depicted in FIG. 10*a*) to a closed position (depicted in FIG. 10*b*). In the present example, a collapse button (not shown) is positioned on the handle portion 202 of the controller 200 such that a user may depress the button and fold the body portion 204 relative to the handle portion, in a direction generally denoted by C, to achieve the closed position of FIG. 10*b*. In one embodiment, the collapse button (not shown) releases a catch mechanism (not shown) positioned inside the controller 200 to allow for adjustment of the body portion 204 relative to the handle portion 202.

Figure 11A:
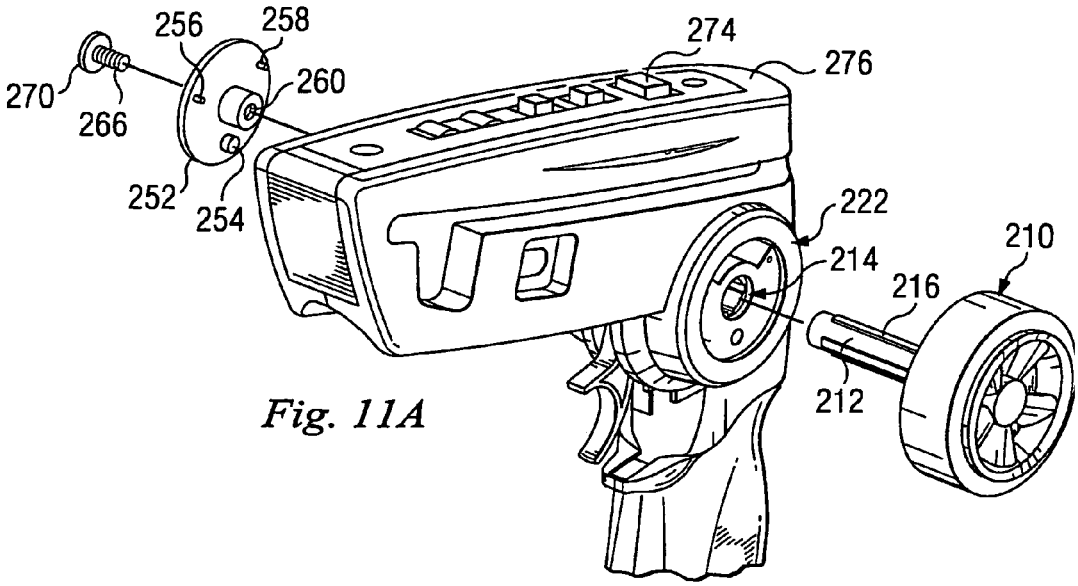
FIG. 11*a* is a perspective view of the controller with a steering wheel, a locking plate and a screw exploded from the controller.
Figure 11B:
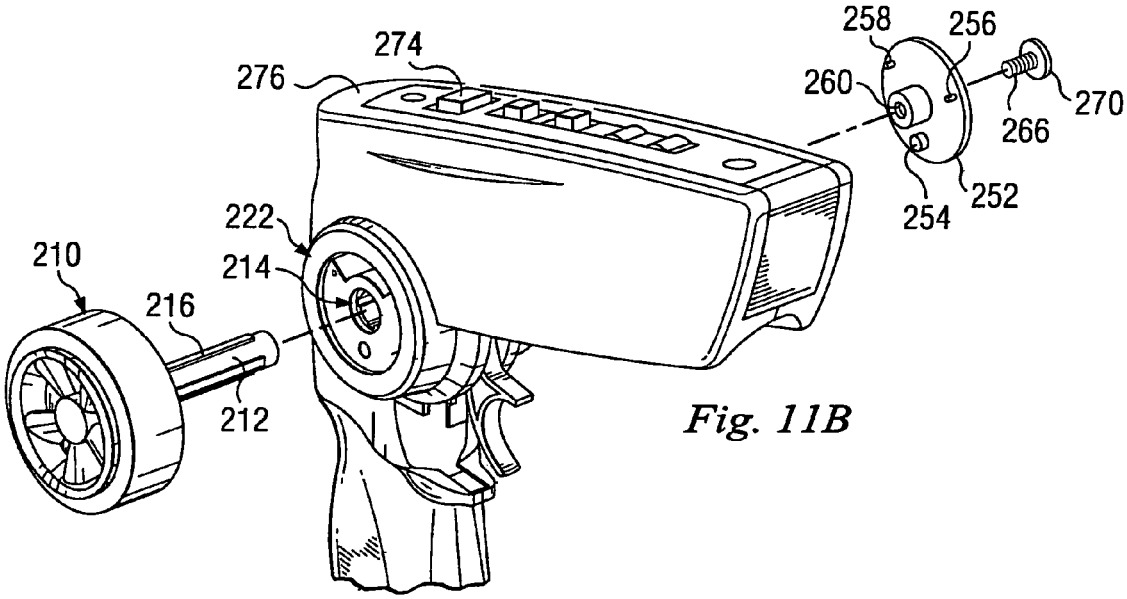
FIG. 11*b* is a perspective view of the controller depicting the exploded arrangement of FIG. 11*a* in a reversed orientation.

The controller 200 includes a modular steering wheel 210, which is adapted for use on either side of the controller to provide for right-handed or left-handed use (as represented in FIGS. 11*a* and 11*b*). Referring to FIGS. 11*a* and 11*b*, in one embodiment, a steering shaft 212 is integrally formed with and extends orthogonally from the steering wheel 210 to engage a rotatable element 214 of the controller 200. In the present example, the rotatable element 214 is the portion of the controller 200 that electromechanically interacts with a steering control circuit (to be described with reference to FIG. 15*a*-15*c*) to provide the desired communication between the steering wheel 210 and the servomotor (housed in 36) of the radio-controlled car 10. In this manner, movement of the steering wheel 210 results in steering of the radio-controlled car 10 as will be further described with respect to FIGS. 15*a*-15*c*.

Referring to FIGS. 11*a*-14, to facilitate engagement of the steering shaft 212 to the rotatable element 214, in one embodiment, the steering shaft includes a plurality of longitudinally-extending ribs 216 formed along the steering shaft to fit to corresponding longitudinally-extending grooves 218 formed in the rotatable element. Thus, in the present example, to engage the controller 200 from either side of the controller, the steering shaft 212 is inserted into a bore 220 defined through the rotatable element 214 and is pressure fit until the grooves 218 of the rotatable element receive the ribs 216 of the steering shaft 212 in a corresponding engagement.

Figure 12:
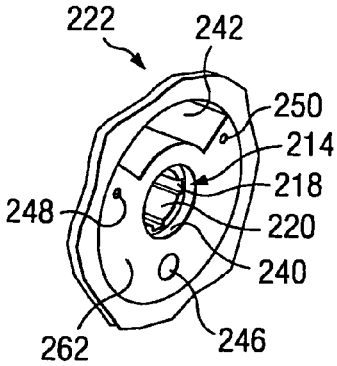
FIG. 12 is a perspective view of a steering interface of the controller.

To further facilitate the engagement of the steering wheel 210 with either side of the controller 200, in one embodiment, the controller includes a pair of substantially similar steering wheel interfaces 222 (one of which is shown) positioned on opposing sides of the controller. For sake of clarity, only the steering wheel interface 222 on the left side of the controller 200 as viewed in FIG. 11*a* will be described in detail. Referring to FIG. 12, the steering wheel interface 222 includes a bore 240 concentrically disposed therethrough for communicating with the bore 220 defined through the rotatable element 214. A groove 242 is further formed in the steering wheel interface 222 to receive a corresponding protrusion 244 (FIG. 14) extending inwardly (toward the controller 200) from the steering wheel 210. In one embodiment, the groove 242 is curved and the corresponding protrusion 244 has a curved cross-section corresponding to the degree of curvature of the groove such that, upon engagement, the protrusion can be moved, or rotated, through the groove.

Figure 13:
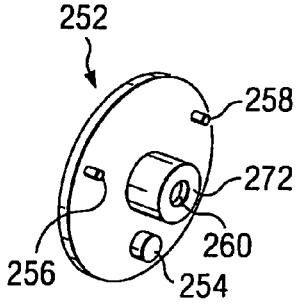
FIG. 13 is a perspective view of the locking plate of the controller.
Figure 14:
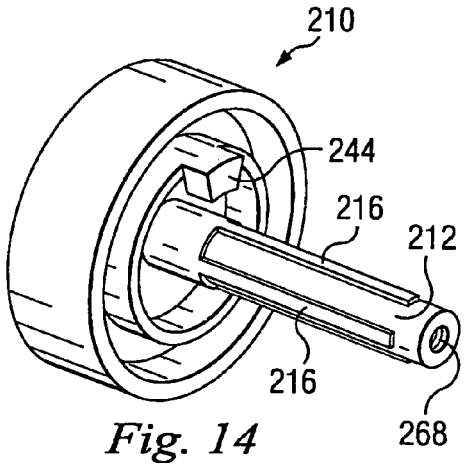
FIG. 14 is a perspective view of the steering wheel of the controller.

In one embodiment, the steering wheel interface 222 further includes three slots 246, 248 and 250 such that when the steering wheel interface does not receive the steering wheel, it may alternatively receive a locking plate 252 (FIG. 13), which facilitates locking of the steering wheel 210 to the controller 200 as will be described. Of course, the illustration of the three slots 246, 248 and 250 is merely exemplary of the number and shape of slots that are defined in the steering wheel interface 222 for receiving the locking plate 252, and it is to be understood that any number or shapes of slots may be defined therein to receive the locking plate. Referring to FIG. 13, the locking plate 252 includes three protrusions 254, 256 and 258, which correspond to the three slots 246, 248 and 250, respectively, of the steering wheel 210. In one embodiment, the protrusions 254, 256 and 258 are snap-fit to the slots 246, 248 and 250, respectively. Accordingly, the locking plate 252 can engage the steering wheel interface 222 opposite the steering wheel interface 222 being engaged by the steering wheel 210.

In the present example, the locking plate 252 further includes a bore 260 defined concentrically therethrough to provide communication through the locking plate and to the steering shaft 212 inserted from the opposite side of the controller 200. In one embodiment, the steering wheel interface 222 includes a recessed portion 262 having a diameter corresponding to the diameter of the locking plate 252, which allows the locking plate to be substantially flush with the steering wheel interface when engaged therewith.

Upon engagement of the steering wheel 210 to one steering wheel interface 222 and engagement of the locking plate 252 to the other steering wheel interface, a screw 266 (FIGS. 11*a* and 11*b*) is inserted into the bore 260 of the locking plate 252 to engage the distal end of the steering shaft 212, which includes a threaded recess 268 (FIG. 14) for receiving the screw. A screw head 270, which may be integrally formed with the screw 266, is adapted to engage a rim 272 of the locking plate 252, thereby securing the steering wheel 210 and the locking plate to the controller 200. Accordingly, the steering wheel 210 can now electromechanically interact with the radio-controlled car 10.

As can be appreciated, if the steering wheel 210 is secured in the above manner for left-handed use, i.e. the configuration of FIGS. 10*a*, 10*b* and 11*a*, and a right-handed configuration is desired, the controller can be reconfigured for right-handed use in a fairly simple manner by unscrewing the screw 266 from the steering shaft 212 and removing the steering wheel 210 and the locking plate 252 from the controller. As the steering wheel interfaces 222 are substantially similar, the locking plate 252 can be engaged with the left steering wheel interface (as viewed in FIG. 11*b*) and the steering wheel 210 can be engaged with the right steering wheel interface (as viewed in FIG. 11*b*) to configure the controller for right-handed use. The screw 266 is then inserted through the locking plate 252 and into the steering shaft 212, thereby securing the steering wheel 210 and the locking plate to the controller 200, and readying the controller for right-handed use.

Moreover, in an additional embodiment, an additional steering wheel substantially similar to the steering wheel 210 may be disposed on the distal end of the steering shaft 212. In such an embodiment, the steering shaft 212 is predisposed in the housing 201 such that both right-handed use and left-handed use is possible without having to interchange the steering wheel 210 from one side of the controller 200 to the other.

Referring again to FIG. 10*a*, the controller 200 further includes a left/right switch 274 on a top portion 276 of the controller, which can be actuated to either a "left" position or a "right" position (not shown but understood to be indicated on the controller) to communicate with the steering control circuit (FIG. 15*a*) to provide the desired movement of the radio-controlled car 10 relative to the orientation of the steering wheel 210 on the controller. It is understood that other conventional buttons associated with the operation of the radio-controlled car 10 may be disposed on the top portion 276 of the controller 200, such as an on/off button and drift control buttons. However, as these buttons and their associated functions are conventional, they will not be described in detail. Moreover, the positioning of the various buttons on the controller 200 are for purposes of example only, and are not intended to be limiting.

Figure 15A:
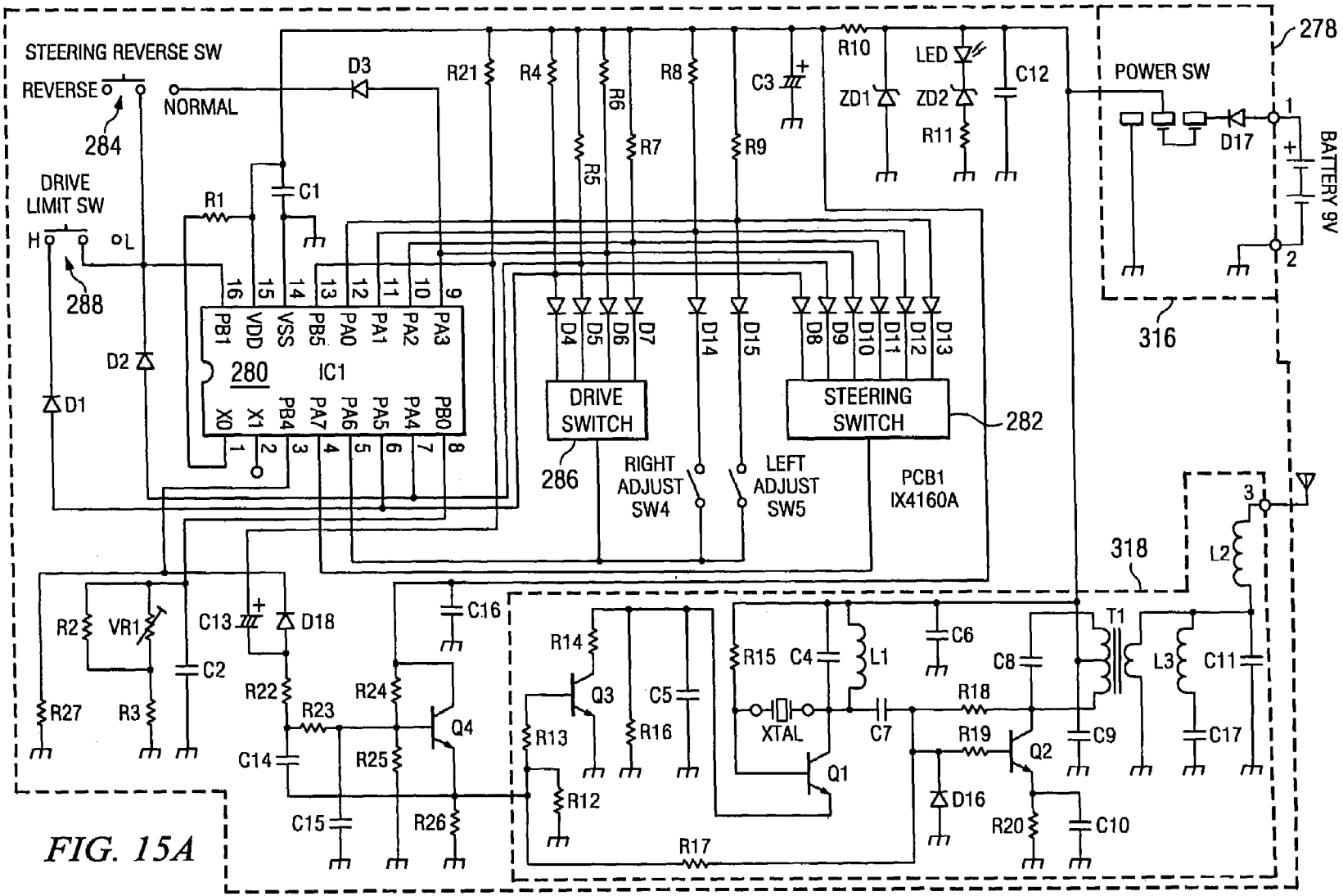
FIG. 15*a* is an exemplary circuit diagram for the controller of FIG. 10*a* illustrating a steering control circuit.

Referring now to FIG. 15*a*, an exemplary circuit 278 includes an integrated circuit (IC) 280 having a microcontroller (not shown) and a plurality of ports, a steering switch 282, a steering reverse switch 284, a drive switch 286, and a drive limit switch 288. For purposes of example, the IC 280 is a SPMC05 made by Sunplus. As will be described later in greater detail, the steering switch 282 provides electrical connections between different ports of the IC 280 in response to movement of the steering shaft 212. The steering reverse switch 284 corresponds to the left/right switch 274 (FIG. 10*a*) and is operable to switch steering signals in the circuit 278, between "left" and "right" steering contexts. The drive switch 286, which may be controlled using the drive limit switch 288, provides a speed limiting mechanism that enables a user to limit a maximum speed allowed by the controller 200.

The steering reverse switch 284 is in communication with a port PB1 of the IC 280. In the steering reverse switch's "normal" setting (which is for right-handed users in the present example), the steering reverse switch 284 supplies a signal from port PA3 to port PB1 by closing a circuit between the two ports. In the steering reverse switch's "reverse" setting (e.g., for left-handed users), the steering reverse switch 284 blocks the signal from port PA3 to port PB1 by opening the circuit between the two ports. Accordingly, reversal of the steering signals may be accomplished by user actuation of the left/right switch 274 and the corresponding steering reverse switch 284.

Figure 15B:
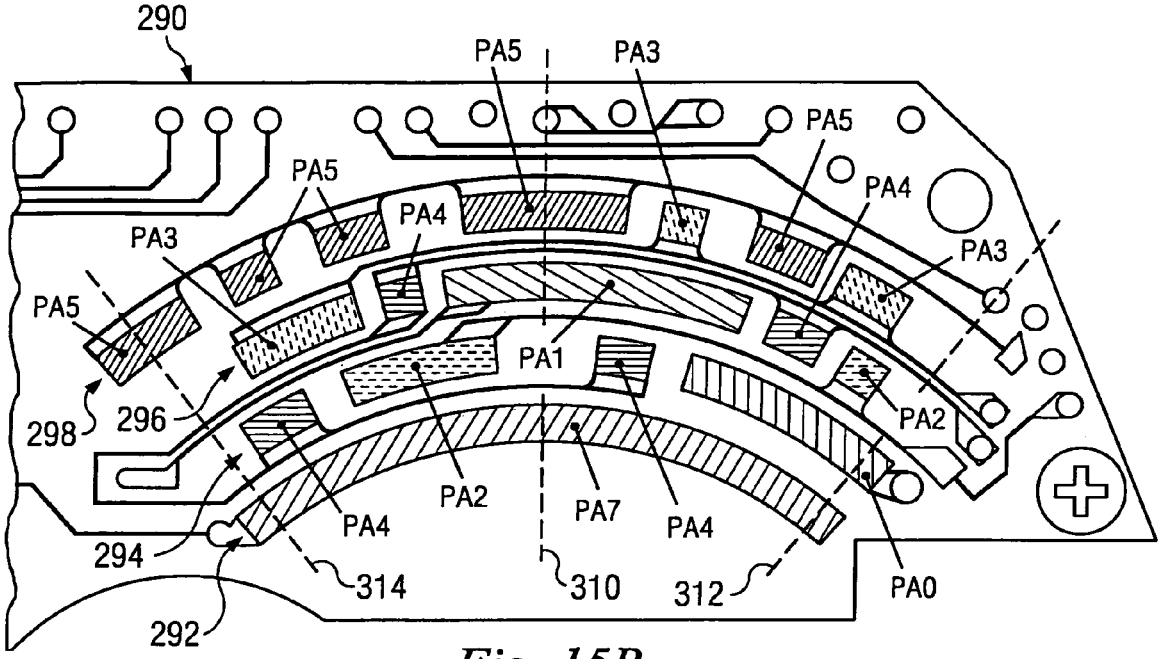
FIG. 15*b* is a top plan view of a printed circuit board housed within the controller.

With additional reference to FIG. 15*b*, an exemplary embodiment of the steering switch 282 is illustrated on a circuit board 290 that forms part of the circuit 278. The steering switch 282 includes a plurality of terminal plates that are arranged into seven groups PA0-PA5 and PA7, with the terminal plates within each group being electrically connected to one another. Furthermore, each group of terminal plates PA0-PA5 and PA7 is connected to a corresponding port (e.g., ports PA0-PA5 and PA7, respectively) of the IC 280. For purposes of illustration, individual terminal plates will be referred to by their group name (e.g., terminal plate PA1 is a terminal plate from group PA1). In the present example, the terminal plates PA0-PA5, PA7 are arranged into four rows 292, 294, 296, 298. The rows 292, 294, 296, 298 may be viewed as a series of concentric semicircles having an origin at the steering shaft 212: The terminal plates PA0-PA5, PA7 are positioned within the rows 292, 294, 296, 298 with insulating areas or "breaks" between the various terminal plates.

Figure 15C:
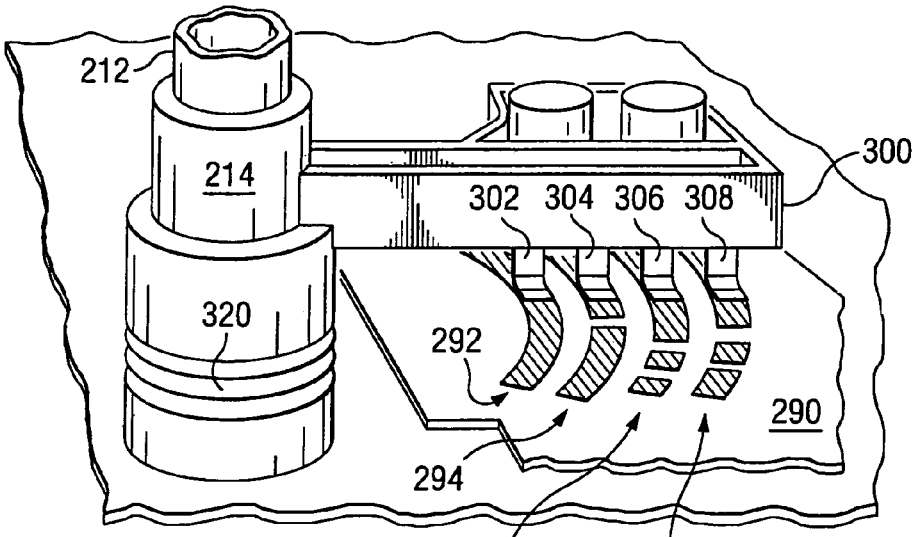
FIG. 15*c* is a schematic view depicting the electromechanical interaction between a steering shaft of the controller and the printed circuit board of FIG. 15*b*.

Referring also to FIG. 15*c*, an engagement member 300 extends perpendicularly from the rotatable element 214 and approximately parallel to the circuit board 290. Attached to the engagement member 300 are four electrically connected terminal "brushes" 302, 304, 306, 308 that extend downwards from the engagement member 300 towards the circuit board 290. Each brush 302, 304, 306, 308 is aligned with one of the rows 292, 294, 296, 298 of terminal plates.

In operation, when the steering shaft 212 is rotated, the rotatable element 214 is rotated, which, in turn, causes the engagement member 300 to move the brushes 302, 304, 306, 308 in an arc along the corresponding rows 292, 294, 296, 298. This movement connects each brush 302, 304, 306, 308 with one or none (if over an insulated area) of the terminal plates PA0-PA5, PA7. In the present example, the brush 302 is always in contact with the terminal plate PA7. Accordingly, the steering switch 282 provides connections between the terminal plate PA7 and up to three other terminal plates from PA0-PA5. As can be seen with reference to the circuit of FIG. 15*a*, this provides an electrical connection between the port PA7 of the IC 280 and up to three other ports PA0-PA5 of the IC 280. These electrical connections serve as steering signals that are used by software instructions executed by the IC 280 to steer the radio-controlled car 10 as described below.

Referring also to Table 1 (below), the illustrated arrangement of terminal plates PA0-PA5 in rows 294, 296, 298 provides thirty-one different steering signals. Table 1 includes a leftmost data column, three columns representing (from left to right) the terminal plates PA0-PA5 that are currently connected to PA7 by the brushes 304, 306, 308, respectively, and a rightmost column indicating a steering result. As Table 1 illustrates which of the terminal plates PA0-PA5 are connected to terminal plate PA7, there is no column representing terminal plate PA7 (or corresponding brush 302). As previously described, the steering reverse switch 284 may be used to reverse the left/right context of rows D01-D15 and D17-D31. In the present example, the RESULT column of Table 1 represents a right-handed context, with the upper 15 rows being left turn signals and the lower 15 rows being right turn signals. If the steering reverse switch 284 is reversed, then the upper 15 rows will become right turn signals and the lower 15 rows will become left turn signals.

TABLE 1

| | Terminal plates connected with PA7 | | | |
|---|---|---|---|---|
| DATA | TERMINAL PLATE IN ROW 294 | TERMINAL PLATE IN ROW 296 | TERMINAL PLATE IN ROW 298 | RESULT |
| D01 | PAO | — | — | MAX LEFT |
| D02 | PAO | PA2 | — | |
| D03 | PAO | PA2 | PA3 | |
| D04 | PAO | — | PA3 | |
| D05 | PAO | PA4 | PA3 | |
| D06 | PAO | PA4 | — | |
| D07 | PAO | PA4 | PA5 | |
| D08 | PAO | — | PA5 | |
| D09 | PAO | PA1 | PA5 | |
| D10 | PAO | PA1 | — | |
| D11 | — | PA1 | — | |
| D12 | — | PA1 | PA3 | |
| D13 | PA4 | PA1 | PA3 | |
| D14 | PA4 | PA1 | — | |
| D15 | PA4 | PA1 | PA5 | LEFT |
| D16 | — | PA1 | PA5 | CENTER |
| D17 | PA2 | PA1 | PA5 | RIGHT |
| D18 | PA2 | PA1 | — | |
| D19 | PA2 | — | — | |
| D20 | PA2 | PA4 | — | |
| D21 | PA2 | PA4 | PA5 | |
| D22 | PA2 | — | PA5 | |
| D23 | PA2 | PA3 | PA5 | |
| D24 | PA2 | PA3 | — | |
| D25 | — | PA3 | — | |
| D26 | — | PA3 | PA5 | |
| D27 | PA4 | PA3 | PA5 | |
| D28 | PA4 | — | — | |
| D29 | PA4 | — | — | |
| D30 | PA4 | — | PA5 | |
| D31 | — | — | PA5 | MAX RIGHT |

To illustrate the operation of the steering switch 282, three DATA rows will now be described in greater detail. When the brushes 304, 306, 308 are aligned with a center line denoted by reference number 310 (FIG. 15*b*), the steering is centered (DATA D16 of Table 1) and no left/right signal is being produced. In this position, brush 304 (aligned with row 294) is not in contact with any terminal plate, brush 306 (aligned with row 296) is in contact with a terminal plate PA1, and brush 308 (aligned with row 298) is in contact with a terminal plate PA5. Accordingly, ports PA1 and PA5 are connected to port PA7 of the IC 280. The IC 280 interprets this as a "center" steering signal (as indicated by the RESULT column). To facilitate the "center" steering signal as being the neutral position, i.e. when no force is imparted to the steering wheel 210, a spring 320 may be provided around the rotatable element 214 to maintain the neutral position.

Because the steering reverse switch 284 is in a right-handed context, when the brushes 304, 306, 308 are aligned with a rightmost line denoted by reference number 312, the steering is provided with a maximum left turn signal (DATA D01 of Table 1). In this position, brush 304 is in contact with a terminal plate PA0, and brushes 306, 308 are not in contact with any terminal plates. When the brushes 304, 306, 308 are aligned with a leftmost line denoted by reference number 314, the steering is provided with a maximum right turn signal (DATA D31 of Table 1). In this position, brushes 304, 306 are not in contact with any terminal plates, and brush 308 is in contact with a terminal plate PA5. As previously described, moving the steering reverse switch 284 to select a left-handed context, which can be accomplished by a user by moving the switch 274 to the "left" position, will reverse the steering (e.g., the rightmost line 312 (DATA D01 of Table 1) will signify a maximum right turn signal and the leftmost line 314 (DATA D31 of Table 1) will signify a maximum left turn signal). This is summarized in Table 2 below.

TABLE 2

| Alignment of brushes | Signal produced by Steering Switch | Steering Reverse Switch setting | Modulation to RF |
|---|---|---|---|
| Rightmost line 312 | D01 (max left signal) | Normal (e.g., Right-handed) | D01 (max left signal) |
| Leftmost line 314 | D31 (max right signal) | Normal | D31 (max right signal) |
| Rightmost line 312 | D01 (max left signal) | Reverse (e.g., Left-handed) | D31 (max right signal) |
| Leftmost line 314 | D31 (max right signal) | Reverse | D01 (max left signal) |

Accordingly, even though the physical steering interface provided by the rotation of the rotatable element 214 and the interaction between the brushes 302, 304, 306, 308 and terminal plates 292, 294, 296, 298 remains fixed, the steering itself may be reversed using the steering reverse switch 284.

It is understood that the steering circuit 278 and associated components illustrated in FIGS. 15*a*-15*c* form an exemplary implementation, and other circuits and/or components may be used to achieve the same result. For example, more or fewer brushes 302, 304, 306, 308 and/or terminal plates 292, 294, 296, 298 may be used, the terminal plates may be arranged in a different order, and more or fewer signals may be provided using the steering switch 282. In addition, an entirely different type of interface may be used. Furthermore, the reversal of the steering signals may be produced using circuit components rather than software instructions. For example, the steering reverse switch 284 may be associated with circuit components that may be used to reverse the input or output of the steering switch 282. Other circuit components or subcircuits may be connected, such as a power subcircuit 316 and a transceiver subcircuit 318.

Referring again to FIGS. 1-9, in operation, the radio-controlled car 10 is assembled by disposing the body 12 on the chassis 14 and the controller 200 is assembled by positioning the steering wheel 210 on the controller in the desired orientation relative to the user. The radio-controlled car 10 and the controller 200 are then turned "on" via conventional buttons associated with each of the car and the controller. Movement of the radio-controlled car 10 is then controlled by a user via the controller 200. For example, in one embodiment, a right-handed user may have positioned the steering wheel 210 on the right side of the controller 200 such that left/right movement of the radio-controlled toy car 10 is controlled by the right hand of the user by imparting forward (right movement) or rearward (left movement) motion to the steering wheel 210. In the present example, the user can additionally control forward/backward movement of the radio-controlled car 10 with the left hand by imparting forward (forward movement) or rearward (rearward movement) motion to the trigger 206. If a left-handed user were to use the controller 200, the steering wheel 210 can be repositioned on the opposite side of the controller in the manner described above. As can be appreciated, the above example is merely exemplary and, therefore, no particular orientation of the steering wheel 210 relative to the controller 200 is required for right-handed or left-handed users.

Figure 16A:
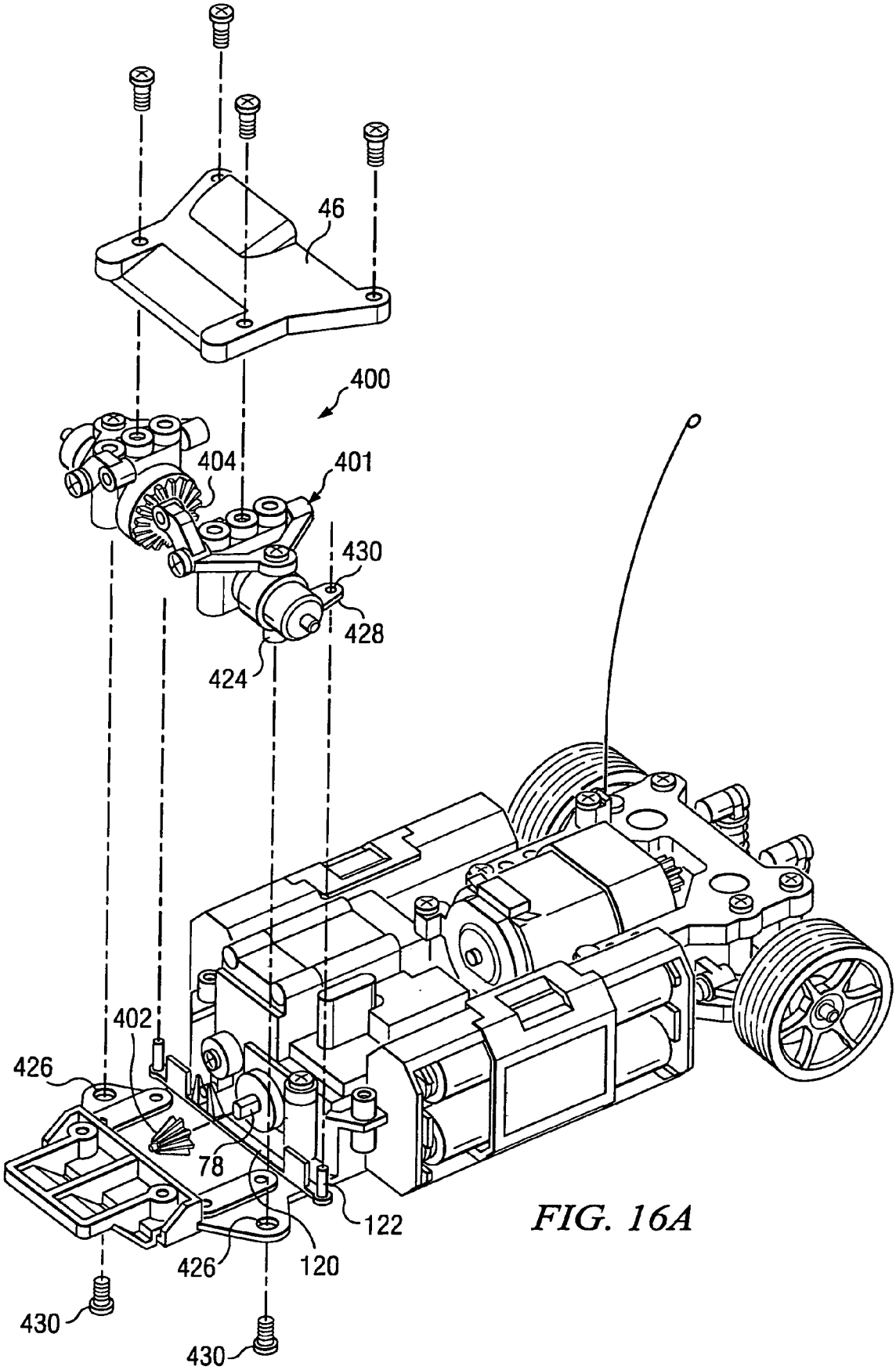
FIG. 16*a* is perspective view of the chassis of FIG. 3 with a modular, insertable front-wheel drive assembly exploded from the chassis.

Several modifications may be made to the radio-controlled car 10 to enhance, or otherwise alter, performance. For example, and referring now to FIGS. 16*a* and 16*b*, the radio-controlled car 10 can be converted from two-wheel drive to four-wheel drive via a modular four-wheel drive kit 400, which, in one embodiment, is adapted to be inserted into the front portion of the chassis 14 in an area covered by the front plate 46. The four-wheel drive kit 400 is modular in the sense that it may be provided separately from the chassis 14 and be incorporated into the chassis at any time. In one embodiment, the four-wheel drive kit 400 includes a front-wheel drive assembly 401 and a drive shaft gear, such as a cone gear 402, which is adapted to be positioned on the front distal end of the drive shaft 78 to transfer rotational movement of the drive shaft to a front gear 404 associated with the front-wheel drive assembly.

Figure 16B:
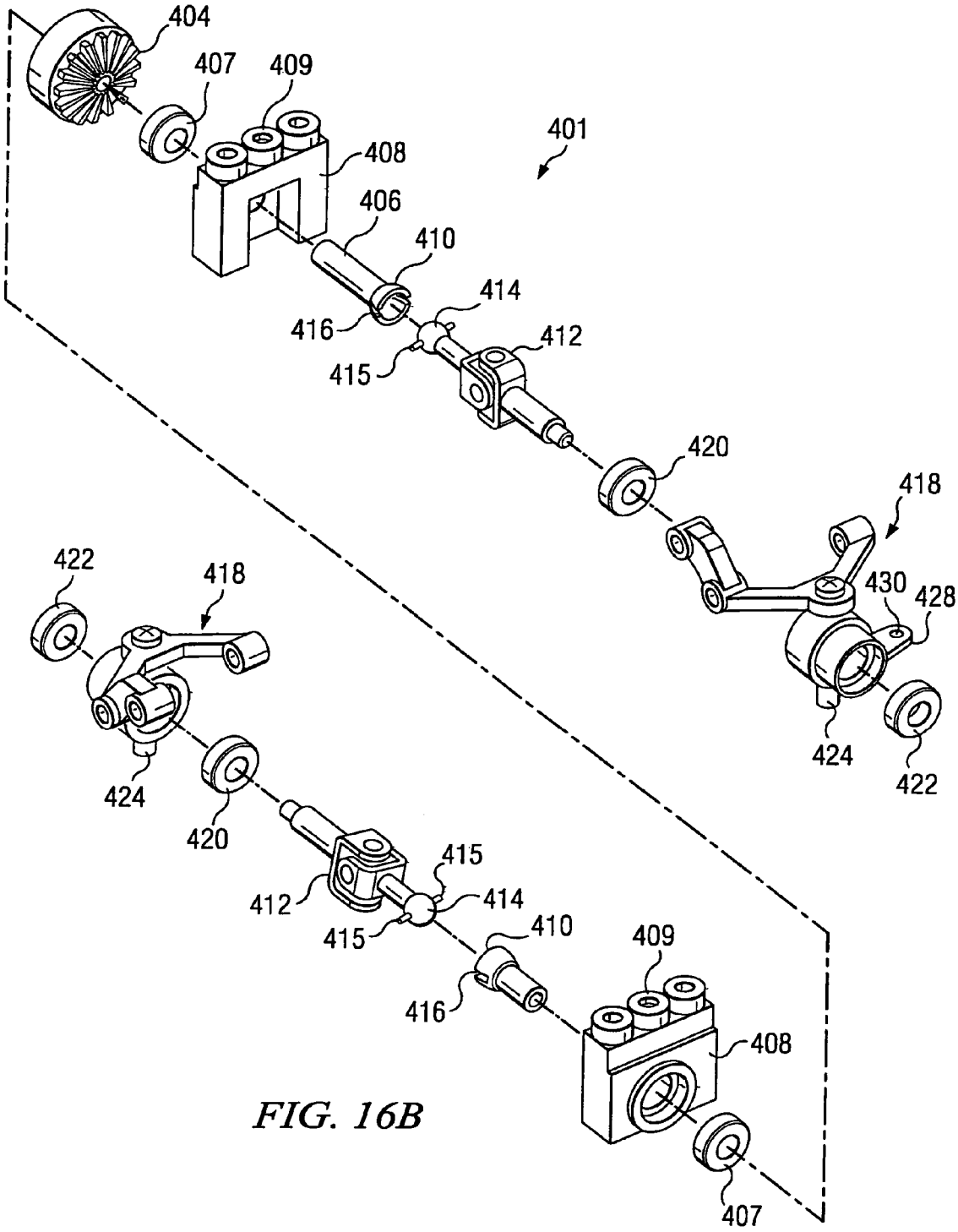
FIG. 16*b* is an exploded view of the modular front-wheel drive assembly of FIG. 16*a*.

As is more clearly illustrated in FIG. 16*b*, the front gear 404 is coupled to a pair of universal joint members 406 via a pair of bearings 407. In one embodiment, the universal joint members 406 are friction fit to the front gear 404 such that turning of the radio-controlled car 10 causes slippage of the universal joint members 406 relative to the front gear 404, thereby allowing the friction fit to function as a differential arrangement. It is understood, however, that the front gear 404 may be equipped with alternative differential arrangements, such as internal differential gears, to allow for the conventional splitting of torque transferred through the drive shaft 78, which allows the front wheels 38 (FIG. 1) to rotate at different speeds during turning of the radio-controlled car 10. It is further understood that the universal joint members 406 can be replaced with a single rod member passing through the front gear 404. In one embodiment, the universal joint members 406 are configured to pass through a pair of housing members 408, which include receptacles 409 for aiding in securing the front-wheel drive assembly 401 to the radio-controlled car 10 as will be described.

In one embodiment, the outer portion of the universal joint members 406 (as viewed in FIG. 16*b*) form sockets 410 to receive a pair of linkage members 412. The inner portion of the linkage members 412 (as viewed in FIG. 16*b*) are formed as balls 414 to fit into the sockets 410. To transmit rotation from the universal joint members 406 to the linkage members 412, the balls 414 include a pair of flanges 415 for engaging a pair of slots 416 formed in the sockets 410 of the universal joint members 406. The linkage members 412 extend through a pair of knuckle arm assemblies 418 via a pair of bearings 420, such that the distal ends of the linkage members 412 are connected to the front wheels (not shown) via another pair of bearings 422. As such, rotation of the drive shaft 78 imparts rotation to the cone gear 402, which, in turn, imparts rotation to the front gear 404, thereby imparting rotation to the universal joint members 406, the linkage members 412 and the front wheels 38, respectively. Thus, the above-described arrangement results in providing the radio-controlled car 10 with a four-wheel drive configuration.

In the present example, the knuckle arm assemblies 418 each include a downwardly depending boss 424 for extending through a bore 426 (FIG. 16*a*) defined through the chassis 14. The knuckle arm assemblies 418 additionally include a flange portion 428, which includes a bore 430 such that the knuckle arm assemblies may be inserted onto the distal flange portions 122 of the tie rod 120. In this manner, the front-wheel drive assembly 401 may be inserted into the chassis 14 in a fairly simple manner. Furthermore, although shown exploded in FIG. 16*b*, it is understood that the front-wheel drive assembly 401 may be provided pre-assembled, thereby further simplifying the four-wheel drive assemblage process as will now be described.

In operation, the radio-controlled car 10 is first prepared for four-wheel drive use by removing the rear wheels 34 and the front wheels 38 via a lug wrench (not shown), which, in one embodiment, is provided to the user in an initial starter kit. In this embodiment, the initial starter kit includes the body 12 and the chassis 14, the chassis being preconfigured for rear two-wheel drive as described above with respect to FIGS. 1-9. In one embodiment, the body 12 is provided in modular form to allow the user to assemble at least a portion of the radio-controlled car 10 prior to use.

Continuing with the preparation of the radio-controlled car 10 for four-wheel drive use, the front damper assemblies 138 are removed from the radio-controlled car 10 by unscrewing their associated screws 140. The front wheel assemblies 124 associated with the initial starter kit are then removed by unscrewing screws (not shown) used to secure the front wheel assemblies to the underside of the chassis 14. The screws 112 used to secure the front plate 46 to the chassis 14 are also removed and the front plate 46 and front wheel assemblies 124. are then removed from the chassis 14, which results in the chassis arrangement of FIG. 16*a*.

The cone gear 402 provided with the four-wheel drive kit 400 is then aligned with and inserted onto the drive shaft 78 in a conventional snap-fit connection. Next, the front-wheel drive assembly 401 is inserted into the front portion of the chassis 14 by aligning the bosses 424 of the knuckle arm assemblies 418 with the bores 426 defined through the chassis. Also, upon. insertion, the knuckle arm assemblies 418 each engage the distal flange portions 122 of the tie rod 120 via the bore 430 such that the servomotor (housed in 36) may impart translational movement to the tie rod to control steering of the radio-controlled car 10 as described above with respect to the two-wheel drive configuration.

The front-wheel drive assembly 401 is then secured to the chassis 14 by inserting a pair of screws 430 into the bosses 424 of the knuckle arm assemblies 418 through the underside of the chassis 14 and by reinserting the screws (not shown) taken out during removal of the original front wheel assemblies 124. Although not shown, it is understood that the housing members 408 include receptacles formed in the underside thereof to receive the screws previously associated with the original front wheel assemblies 124. The front plate 46 is then reattached to the radio-controlled car 10 via the screws 50, thereby readying the car for four-wheel drive use. It is understood that the above assemblage process for modifying the radio-controlled car 10 to a four-wheel drive configuration is merely exemplary and it is contemplated that the above assembly steps may be altered so long as the car is ultimately modified for four-wheel drive use.

Upon modification to the four-wheel drive configuration, the radio-controlled car 10 may be further modified to a front-wheel drive configuration. For example, in one embodiment, the rear axle gear 82 is removed from the chassis 14 by first removing the connectors (not shown) associated with the rear wheel assemblies 84 and the rear axle assembly 44. The rear wheel assemblies 84 and the rear axle assembly 44 are then removed from the chassis 14. The axle 72, including the rear axle gear 82 is then replaced with a shaft (not shown) having no gears. Upon insertion of the wheel assemblies and modified rear axle assembly 44 back into the chassis 14, the bevel gear 76 rotates freely in the rear portion of the chassis as it does not engage a gear associated with the rear axle 72. In this manner, the radio-controlled car 10 is ready for front-wheel drive use.

Additional modifications are contemplated. In one embodiment, the radio-controlled car 10 may be modified to include alternate motors and associated gear assemblies. For example, and referring now to FIG. 17, the generally modular nature of the radio-controlled car 10 allows for the replacement of the motor 32 with a variety of performance-enhancing, or otherwise performance-altering, motors such as motors M1-M8 having the specifications depicted in FIG. 17. FIG. 17 depicts an example of a legend that may be provided with the motors M1-M8 to aid a user in identifying the specifications associated with each motor. It is understood that the specifications depicted in FIG. 17 are for the purposes of example only, and as such, the motor 32 may be replaced with any type of performance-enhancing, or otherwise performance-altering, motor. In one embodiment, the motors having the specifications depicted in FIG. 17 may be sold in kits, and as such, may be color coded to aid a user in identifying the performance aspects of each motor.

In one example, a plurality of motors, represented by M1-M4, having varying power and speed arrangements are provided in a motor kit 500 such that a user may remove the original motor 32 provided with the radio-controlled car 10 and replace the motor 32 with any one of the motors provided in the motor kit 500. As is well understood in the art, the gear ratio of a motor, such as the motors M1-M4, is directly proportional to the power provided by each of the motors M1-M4, yet inversely proportional to the speed provided by each of the motors M1-M4. As such, in one embodiment, the motors M1-M4 of the motor kit 500 may each be provided with a different gear ratio to offer the user a variety of motors M1-M4 with which to replace the motor 32. In the present example, the motors M1-M4 are capable of achieving 26,000 revolutions per minute (hereinafter "RPM"), which may be preferable for the above-described four-wheel drive configuration of the radio-controlled car 10 as such motors may offer less speed but added torque for handling in tight driving conditions.

Of course, the RPM of the motors provided in the motor kit 500 may be variable, and therefore, a motor kit 500*a* may be provided to offer a plurality of motors M5-M8 having a higher RPM relative to the motors M1-M4 of the motor kit 500. For example, the motors M5-M8 may be capable of achieving 30,000 RPM, which may be preferable in driving conditions in which higher speed and less torque are preferable, such as straight-away drag racing. Moreover, as with the motor kit 500, the motors M5-M8 of the motor kit 500*a* may be provided with varying gear ratios to offer the user a variety of motors M5-M8 with which to replace the motor 32. It is understood that the above-described RPM values and the gear ratio values depicted in FIG. 17 are by way of example only, and these values may be altered without departing from the spirit of the present disclosure.

Other alterations may be made to the motors of the motor kits 500 and 500*a* such as providing the motors with brass pinion gears, which may lead to an increased life of such pinion gears. Moreover, the motors M1-M4 and/or M5-M8 may be provided with an associated heat sink to dissipate the heat generated during operation of such motors. Still further, the motor kits 500 and 500*a* may also include alternative bevel and/or axle gears, which can replace the original bevel and axle gears 76 and 82, respectively.

In operation, and referring to FIGS. 5 and 17, the motor 32 is replaced with a performance-altering motor, such as any one of the motors M1-M4 or M5-M8 of motor kits 500 and 500*a*, respectively, by loosening the screws 60 and 66 associated with the rear motor casing 52 and the front motor casing 56, respectively, and removing the motor 32 from the chassis 14. The motor 32 is then separated from the rear motor casing 52 and the front motor casing 56 and is replaced with the desired performance-altering motor. The performance-altering motor is then inserted into the chassis 14 and secured thereto by inserting the screws 60 through the receiving portions 58 of the rear motor casing 52 and inserting the screws 66 through the receiving portions 64 of the front motor casing 56, and further securing the screws 60 and 66 to the bosses 62 and 68, respectively.

Figure 18:
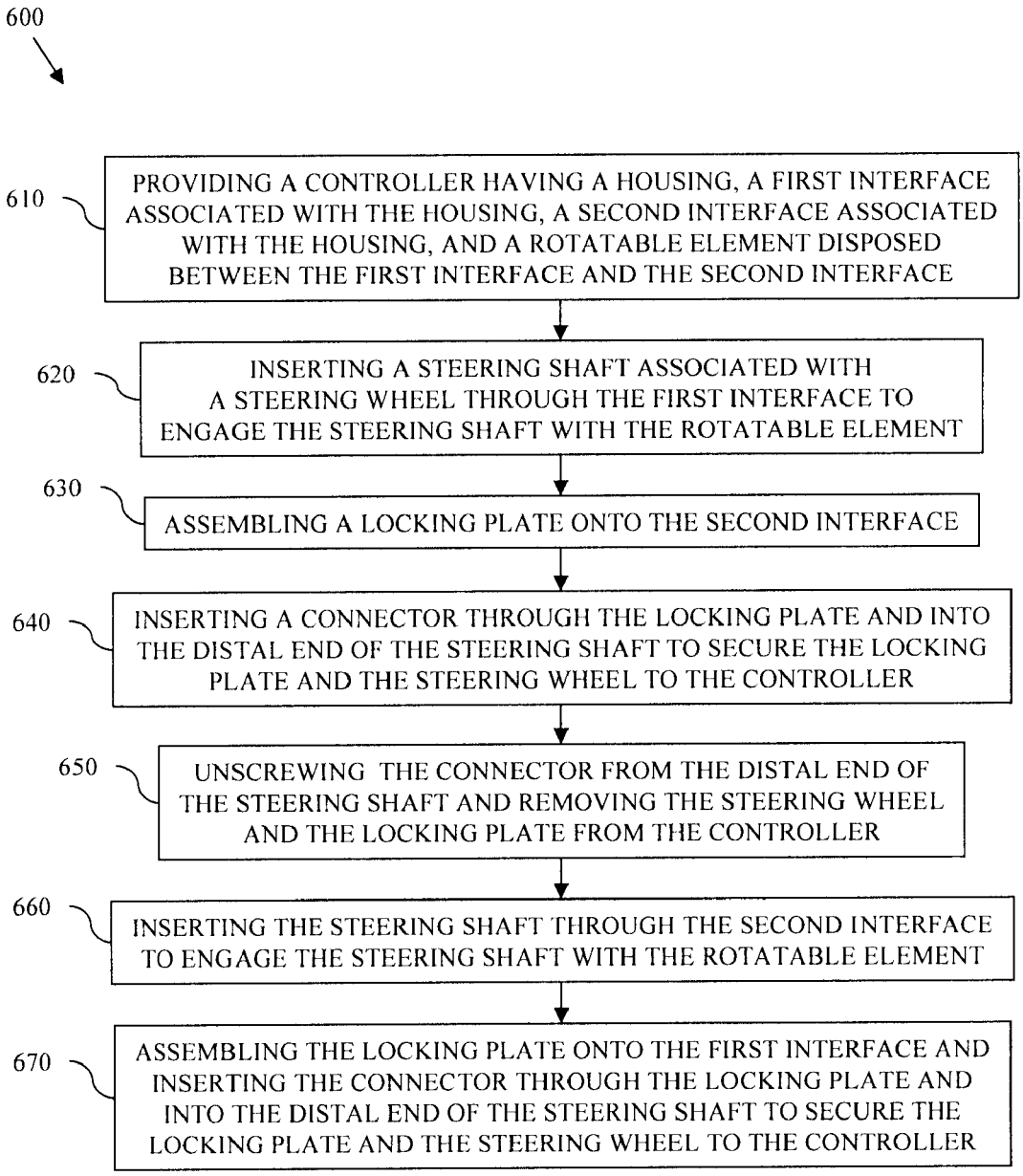
FIG. 18 is a flow-chart diagram of a method of the present disclosure.

FIG. 18 is a flow-chart diagram of a method 600 for assembling a controller for use by a right-handed or left-handed user. The method 600 includes a step 610 comprising providing a controller having a housing, a first interface associated with the housing, a second interface associated with the housing, and a rotatable element disposed between the first interface and the second interface. The method 600 also includes a step 620 comprising inserting a steering shaft associated with a steering wheel through the first interface to engage the steering shaft with the rotatable element. The method 600 also includes a step 630 comprising assembling a locking plate onto the second interface. The method 600 also includes a step 640 comprising inserting a connector through the locking plate and into the distal end of the steering shaft to secure the locking plate and the steering wheel to the controller. The method 600 also includes a step 650 comprising unscrewing the connector from the distal end of the steering shaft and removing the steering wheel and the locking plate from the controller. The method 600 may also include a step 660 comprising inserting the steering shaft through the second interface to engage the steering shaft with the rotatable element. The method 600 may also include a step 670 comprising assembling the locking plate onto the first interface and inserting the connector through the locking plate and into the distal end of the steering shaft to secure the locking plate and the steering wheel to the controller.

The present invention has been described relative to several preferred embodiments. Improvements or modifications that become apparent to persons of ordinary skill in the art after reading this disclosure are deemed within the spirit and scope of the application. For example, a variety of alternate circuit configurations and components may be used to achieve the functionality of the steering control circuit described above. Furthermore, alternate controls may be provided that accomplish similar functions to those described herein. Accordingly, it is understood that several modifications, changes and substitutions are intended in the foregoing disclosure and, in some instances, some features of the invention will be employed without a corresponding use of other features. It is also understood that all spatial references, such as "right", "left," "longitudinal," "top," "side," "back," "rear," "middle," and "front" are for illustrative purposes only and can be varied within the scope of the disclosure. Accordingly, it is appropriate that the appended claims be construed broadly and in a manner consistent with the scope of the invention.

What is claimed is:

1. A method for assembling a controller for use by a right-handed or left-handed user, comprising:

providing a controller having a housing, a first interface associated with the housing, a second interface associated with the housing, and a rotatable element disposed between the first interface and the second interface;

inserting a steering shaft associated with a steering wheel through the first interface to engage the steering shaft with the rotatable element;

assembling a locking plate onto the second interface;

inserting a connector through the locking plate and into the distal end of the steering shaft to secure the locking plate and the steering wheel to the controller; and unscrewing the connector from the distal end of the steering shaft and removing the steering wheel and the locking plate from the controller.

2. The method of claim 1 further comprising inserting the steering shaft through the second interface to engage the steering shaft with the rotatable element.

3. The method of claim 2 further comprising assembling the locking plate onto the first interface and inserting the connector through the locking plate and into the distal end of the steering shaft to secure the locking plate and the steering wheel to the controller.

* * * * *